US006337441B1

(12) United States Patent
Aosaki

(10) Patent No.: US 6,337,441 B1
(45) **Date of Patent: *Jan. 8, 2002**

(54) SHIELDED MULTICONDUCTOR CABLE AND MANUFACTURING METHOD THEREFOR

(75) Inventor: Yasuhisa Aosaki, Kanagawa (JP)

(73) Assignee: Koakkus Kabushiki Kaisha (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/155,074

(22) PCT Filed: Jan. 21, 1998

(86) PCT No.: PCT/JP98/00223

§ 371 Date: Oct. 8, 1998

§ 102(e) Date: Oct. 8, 1998

(87) PCT Pub. No.: WO98/32139

PCT Pub. Date: Jul. 23, 1998

(30) Foreign Application Priority Data

Jan. 21, 1997 (JP) ..... 9-8807

(51) Int. Cl.[7] ..... H01B 7/18; H01B 11/06

(52) U.S. Cl. ..... 174/102 R; 174/105 R; 174/106 R; 174/36

(58) Field of Search ..... 174/102 R, 105 R, 174/106 R, 113 R, 36, 110 R, 116; 29/876

(56) References Cited

U.S. PATENT DOCUMENTS

| | | | | |
|---|---|---|---|---|
| 410,953 A | | 9/1889 | Brooks, Jr. | |
| 1,705,949 A | | 3/1929 | Williams | |
| 1,722,153 A | | 7/1929 | Meurer et al. | |
| 1,935,323 A | | 11/1933 | Kemp et al. | |
| 1,957,487 A | * | 5/1934 | Buckley | 173/264 |
| 2,948,647 A | * | 8/1960 | Lorch et al. | 154/228 |
| 3,340,353 A | | 9/1967 | Mildner | 174/106 |
| 3,614,290 A | * | 10/1971 | Plate | 174/26 R |
| 3,636,234 A | | 1/1972 | Wakefield | 174/36 |
| 3,927,247 A | | 12/1975 | Timmons | 174/36 |
| 4,154,976 A | * | 5/1979 | Brorein | 174/115 |
| 4,328,394 A | | 5/1982 | Aloisio, Jr. et al. | 174/106 D |
| 4,449,013 A | | 5/1984 | Garschick | 174/103 |
| 4,751,614 A | | 6/1988 | Mehnert | 361/437 |
| H631 H | * | 5/1989 | Hamad et al. | 29/745 |
| 4,847,448 A | | 7/1989 | Sato | 174/103 |
| 5,068,497 A | | 11/1991 | Krieger | 174/106 R |
| 5,321,202 A | | 6/1994 | Hillburn | 174/36 |
| 5,414,213 A | | 5/1995 | Hillburn | 174/36 |
| 5,434,354 A | | 7/1995 | Baker et al. | 174/36 |
| 5,521,331 A | | 5/1996 | Hillburn | 174/36 |

FOREIGN PATENT DOCUMENTS

| | | | | |
|---|---|---|---|---|
| JP | 57-87413 | | 5/1982 | |
| JP | 4-106815 | * | 4/1992 | H01B/13/22 |

* cited by examiner

*Primary Examiner*—Dean A. Reichard
*Assistant Examiner*—William H Mayo, III
(74) *Attorney, Agent, or Firm*—Nixon Peabody LLP; Jeffrey L. Costellia

(57) ABSTRACT

The present invention has a shielded multi-core cable manufacturing method which involves a step of drawing a cylindrical conductive pipe having inserted therein (a) two first cylindrical insulator rods in each of which a conductive core is embedded concentrically therewith, (b) two second cylindrical insulator rod, and/or (c) a cylindrical insulating tube thereby obtaining the shielded multi-core cable which has a construction in which (a) two first insulator rods each having embedded therein one of two conductive cores, (b) two second insulator rods and/or (c) second insulating tube, are held in cylindrical shielding conductive pipe.

2 Claims, 11 Drawing Sheets

SHIELDED MULTICONDUCTOR CABLE AND MANUFACTURING METHOD THEREFOR

FIELD OF THE INVENTION

The present invention relates to a shielded multi-core cable in which a plurality of insulator rods each having embedded therein one of a plurality of conductive cores, are tightly received in a cylindrical shielding conductive pipe so that the conductive cores are ;held therein around the center axis thereof, and the invention also pertains to a method of making such a shielded multi-core cable.

DESCRIPTION OF THE RELATED ART

A conventional shielded multi-core cable and its manufacturing method will be described with reference to FIGS. 21 through 24; the manufacturing method involves a sequence of steps described below.

The manufacture begins with the preparation of an insulator-covered wire G which has plural, for example, two conductive cores $A_1$ and $A_2$ circular in cross-section, for instance, and embedded side by side in a cylindrical insulator rod F at equal angles around the center axis thereof (FIGS. 21A and B), and a cylindrical conductive pipe E which has an inner diameter $\phi_{E1}$ nearly equal to or larger than the outer diameter $\phi_{F2}$ of the insulator rod F (FIGS. 21C and D).

Then, the insulator-covered wire G is inserted into the conductive pipe E (FIGS. 22A and B).

For the sake of brevity, the conductive pipe E is shown to have an inner diameter $\phi_{E1}$ substantially equal to the outer diameter $\phi_{F2}$ of the insulator rod F of the insulator-covered wire G.

Next, the conductive pipe E having inserted therein the insulator-covered wire G is subjected to drawing by means of a drawing die K (FIGS. 23A and B) having a circularly-sectioned through hole H whose inner diameter $\phi_H$ gradually varies lengthwise thereof from one end having an inner diameter $\phi_{H1}$ nearly equal to or larger than the outer diameter $\phi_{E2}$ of the conductive pipe E to the other end having an inner diameter $\phi_{H2}$ smaller than the outer diameter $\phi_{E2}$ of the conductive pipe E. That is, the conductive pipe E is drawn through the through hole H of the drawing die K from the one end of the larger inner diameter $\phi_{H1}$ to the other end of the smaller inner diameter $\phi_{H2}$ (FIG. 23A). By this, a conventional shielded multi-core cable M is obtained which has a construction in which two conductive cores A1' and A2', embedded side by side in a cylindrical insulator rod F' tightly fitted in and held integrally with a cylindrical shielding conductive pipe E', lie in juxtaposition to each other in the shielding conductive pipe E' which has an outer diameter $\phi_{H2}'$ equal to the smaller inner diameter $\phi_{H2}$ of the through hole H of the drawing die K (FIGS. 24A and B).

In this instance, since the inner diameter $\phi_{E1}'$ of the shielding conductive pipe E' of the shielded multi-core cable M is smaller than the inner diameter $\phi_{E1}$ of the conductive pipe E, the insulating material forming the insulator rod F of the insulator-covered wire G is forced out of the shielding conductive pipe E' of the shielded multi-core cable M. The excess insulating material is removed after the drawing step.

The conventional shielded multi-core cable M (FIGS. 24A and B), fabricated by the method depicted in FIGS. 21 through 24, is commonly used after being subjected to an end treatment as depicted in FIG. 25. One end portion of the shielding conductive pipe E' is peeled off to expose one end portion of the insulator rod F', and the exposed end portion of the latter is partly removed to expose the two conductive cores $A_1'$ and $A_2'$ at one end thereof. Occasionally the situation arises where it is desirable that the free end portion of the two conductive cores $A_1'$ and $A_2'$ be widely spaced apart.

Since the two conductive cores $A_1'$ and $A_2'$ are embedded side by side in the common insulator rod F', however, there is no choice but to gradually open up the space between the two cores $A_1'$ and $A_2'$ from the free end position of the insulator rod F' toward their free ends by making a cut in the insulator rod F' between the two conductive cores $A_1'$ and $A_2'$ ftom the free end of the rod F' to that of the shielding conductive pipe E'.

Accordingly, when it is required that the free ends of the two conductive cores $A_1'$ and $A_2'$ be widely spaced apart in practical use, it is impossible to meet the requirement without elongating the exposed free end portions of the two conductive cores $A_1'$ and $A_2'$ in the abovementioned end treatment or making a cut in the insulator rod F' from the free end thereof toward that of the shielding conductive pipe E' between the conductive cores $A_1'$ and $A_2'$ after the end treatment.

Thus, the conventional shielded multi-core cable M depicted in FIG. 24 has a shortcoming that the space between the free ends of the two conductive cores $A_1'$ and $A_2'$ cannot be opened up in the practical use after the end treatment without making a cut in the insulator rod F' from the free end thereof toward that of the shielding conductive pipe E' or increasing the lengths of the exposed free end portions of the conductive cores $A_1'$ and $A_2'$.

Furthermore, according to the conventional shielded multi-core cable fabricating method shown in FIGS. 21 through 24, if it is possible to obtain, in the step of its preparation (FIGS. 21A and B), the insulator-covered wire G of a construction in which the two conductive cores $A_1$ and $A_2$ embedded side by side in the insulator rod F are exactly symmetrical over the entire length thereof in respect of the plane containing the center axis of the insulator rod F (that is, the conductive cores $A_1$ and $A_2$ are embedded in the insulator rod F so that, in any plane orthogonal to the center axis of the insulator rod F, the line joining the centers of the conductive cores $A_1$ and $A_2$ passes through the center of the insulator rod F and the conductive cores $A_1$ and $A_2$ are both exactly symmetrical with respect to the center of the insulator rod F), the shielded multi-core cable M can be obtained which has the construction wherein the two conductive cores $A_1'$ and $A_2'$ embedded side by side in the insulator rod F' are exactly symmetrical over the entire length thereof in respect of the plane containing the center axis of the insulator rod F' (that is, the conductive cores $A_1'$ and $A_2'$ are embedded in the insulator rod F so that, in any plane orthogonal to the center axis of the insulator rod F', the line joining the centers of the conductive cores $A_1'$ and $A_2'$ passes through the center of the insulator rod F' and the conductive cores $A_1'$ and $A_2'$ are both exactly symmetrical with respect to the center of the insulator rod F').

In practice, however, since the two conductive cores $A_1$ and $A_2$ are both disposed at positions off the center axis of the insulator rod F, it is difficult to prepare the insulator-covered wire G of the abovementioned construction in which the two conductive cores $A_1$ and $A_2$ embedded side by side in the insulator rod F are exactly symmetrical over the entire length thereof in respect of the plane containing the center axis of the insulator rod F (that is. the conductive cores $A_1$ and $A_2$ are embedded in the insulator rod F so that, in any plane orthogonal to the center axis of the insulator rod F, the line joining the centers of the conductive cores $A_1$ and $A_2$ passes through the center of the insulator rod F and the conductive cores $A_1$ and $A_2$ are both exactly symmetrical with respect to the center of the insulator rod F).

On this account, difficultly is encountered in producing, by the step of drawing the conductive pipe E with the insulator-covered wire G inserted therein, the shielded multi-core cable M in which the two conductive cores $A_1'$ and $A_2'$ embedded side by side in the insulator rod F' are exactly symmetrical over the entire length thereof in respect of the plane containing the center axis of the insulator rod F' (that is, the conductive cores $A_1'$ and $A_2'$ are embedded in the insulator rod F so that, in any plane orthogonal to the center axis of the insulator rod F', the line joining the centers of the conductive cores $A_1'$ and $A_2'$ passes through the center of the insulator rod F' and the conductive cores $A_1'$ and $A_2'$ are both exactly symmetrical with respect to the center of the insulator rod F').

For the reasons given above, the conventional shielded multi-core cable manufacturing method depicted in FIGS. 21 through 24 has a defect that intended excellent high-frequency characteristics cannot easily be achieved for the shielded multi-core cable M.

Furthermore, as is evident from the above, according to the conventional shielded multi-core cable manufacturing method shown in FIGS. 21 through 24, since the two conductive cores $A_1'$ and $A_2'$ are embedded side by side in the common insulator rod F', the free ends of the conductive cores $A_1'$ and $A_2'$ can be widely spaced apart only by making a cut in the insulator rod F' from the free end thereof to that of the shielding conductive pipe or lengthening the exposed free end portions of the cores.

Accordingly, an object of the present invention is to provide a novel shielded multi-core cable and its manufacturing method which are free from the abovementioned detects.

Another object of the present invention is to provide a novel shielded multi-core cable of a construction in which the free ends of one and the other conductive cores can be widely spaced apart without lengthening their exposed free end portions.

Still another object of the present invention is to provide a novel shielded multi-core cable manufacturing method which allows ease in manufacturing a shielded multi-core cable with excellent high-frequency characteristics.

BRIEF SUMMARY OF THE INVENTION

A shielded multi-core cable according to an aspect of the present invention has a construction in which a plurality n of insulator rods, each having embedded therein one of a plurality n of conductive cores, are tightly received in a cylindrical shielding conductive pipe so that said plurality n of conductive cores are held therein about the center axis thereof.

A shielded multi-core cable according to another aspect of the present invention has a construction in which a plurality n of first insulator rods, each having embedded therein one of a plurality n of conductive cores, and a plurality n of second insulator rods are tightly received in a cylindrical shielding conductive pipe alternately about the enter axis thereof so that said plurality n of conductive cores are held therein about the center axis thereof.

A shielded multi-core cable according to another aspect of the present invention has a construction in which a cylindrical insulating tube and a plurality n of insulator rods, each having embedded therein one of a plurality n of conductive cores and tightly received in said cylindrical insulating tube about the center axis thereof are tightly received in a cylindrical shielding conductive pipe so that said plurality n of conductive cores are held therein about the center axis thereof.

A shielded multi-core cable according to another aspect of the present invention has a construction in which a cylindrical insulating tube, a plurality n of first insulator rods, each having embedded therein one of a plurality n of conductive cores, and a plurality n of second insulator rods (said plurality n of first insulator rods and said plurality n of second insulator rods being tightly received in said cylindrical insulating tube alternately about the center axis thereof) are tightly received in a cylindrical shielding conductive pipe so that said plurality n of conductive cores are held therein about the center axis thereof.

A shielded multi-core cable manufacturing method according to aspect of the present invention comprises the steps of: (1) preparing a plurality n of insulator-covered wires each having a conductive core embedded in a cylindrical insulator rod concentrically therewith, and a cylindrical conductive pipe having an inner diameter large enough to receive said plurality n of insulator-covered wires; (2) inserting said plurality n of insulator-covered wires into said cylindrical conductive pipe around the center axis thereof; and (3) drawing said cylindrical conductive pipe with said plurality n of insulator-covered wires inserted therein, thereby obtaining a shielded multi-core cable of a construction in which a plurality n of insulator rods, formed by said cylindrical insulator rods of said plurality n of insulator-covered wires and each having embedded therein one of a plurality of conductive cores formed by said conductive cores of said plurality n of insulator-covered cores, are tightly received in a cylindrical shielding conductive about the center axis thereof so that said plurality n of conductive cores are held therein around the center axis thereof, said cylindrical shielding conductive pipe being formed by said cylindrical conductive pipe and having inner and outer diameter smaller than the latter.

A shielded multi-core cable manufacturing method according to another aspect of the present invention comprises the steps of: (1) preparing a plurality n of insulator-covered wires each having a conductive core embedded in a first cylindrical insulator rod concentrically therewith, a plurality n of second cylindrical insulator rods and a cylindrical conductive pipe having an inner diameter large enough to receive said plurality n of insulator-covered wires and said plurality n of second cylindrical insulator rods; (2) inserting said plurality n of insulator-covered wires and said plurality n of second cylindrical insulator rods into said cylindrical conductive pipe alternately around the center axis thereof; and (3) drawing said cylindrical conductive pipe with said plurality n of insulator-covered wires and said plurality n of second cylindrical insulator rods inserted therein, thereby obtaining a shielded multi-core cable of a construction in which a plurality n of first insulator rods, formed by said first cylindrical insulator rods of said plurality n of insulator-covered wires and each having embedded therein one of a plurality n of conductive cores, formed by said conductive cores of said plurality n of insulator-covered wires, and a plurality n of second insulator rods, formed by said plurality n of second cylindrical insulator rods, are tightly received in a cylindrical shielding conductive pipe so that said plurality n of conductive cores are held therein around the center axis thereof, said cylindrical shielding conductive pipe being formed by said cylindrical conductive pipe and having inner and outer diameters smaller than those of the latter.

A shielded multi-core cable manufacturing method according to another aspect of the present invention comprises the steps of: (1) preparing a plurality n of insulator-covered wires each having a conductive core embedded in a first cylindrical insulator rod concentrically therewith a cylindrical insulating tube having an inner diameter large enough to receive said plurality n of insulator-covered wires, and a cylindrical conductive pipe having an inner diameter large enough to receive said cylindrical insulating tube; (2) inserting said plurality n of insulator-covered wires and said cylindrical insulating tube into said cylindrical conductive pipe so that said cylindrical insulating tube is concentric therewith and receives said plurality n of insulator-covered wires arranged around the center axis thereof; and (3) drawing said cylindrical conductive pipe with said plurality n of insulator-covered wires and said cylindrical insulating tube inserted therein, thereby obtaining a shielded multi-core cable of a construction in which a cylindrical insulating tube, formed by said cylindrical insulating tube, and a plurality n of insulator rods, formed by said first cylindrical insulator rods of said plurality n of insulator-covered wires, each having embedded therein one of a plurality n of conductive cores formed by said plurality n of conductive cores and tightly received in said cylindrical insulating tube about the center axis thereof, are tightly received in a cylindrical shielding conductive pipe so that said plurality n of conductive cores are held therein about the center axis thereof, said cylindrical shielding conductive pipe being formed by said cylindrical conductive pipe and having inner and outer diameters smaller than those of the latter.

A shielded multi-core cable manufacturing method according to still another aspect of the present invention comprises the steps of: (1) preparing a plurality n of insulator-covered wires each having a conductive core embedded in a first cylindrical insulator rod concentrically therewith, a plurality n of second cylindrical insulator rods, a cylindrical insulating tube having an inner diameter large enough to receive said plurality n of insulator-covered wires and said plurality n of cylindrical insulator rods, and a cylindrical conductive pipe having an inner diameter large enough to receive said cylindrical insulating tube; (2) inserting said plurality n of insulator-covered wires, said plurality n of second cylindrical insulator rods and said cylindrical insulating tube into said cylindrical conductive pipe so that said cylindrical insulating tube receives said plurality n of insulator-covered wires and said plurality n of second cylindrical insulator rods alternately arranged around the center axis thereof; and (3) drawing said cylindrical conductive pipe with said plurality n of insulator-covered wires, said plurality n of cylindrical insulator rods and said cylindrical insulating tube inserted therein, thereby obtaining a shielded multi-core cable of a construction in which a cylindrical insulating tube, formed by said cylindrical insulating tube, a plurality n of first insulator rods formed by said first cylindrical insulator rods of said plurality n of insulator-covered wires and each having embedded therein one of a plurality n of conductive cores formed by said plurality n of conductive cores, and a plurality n of insulator rods formed by said plurality n of second cylindrical insulator rods (said plurality n of first insulator rods and said plurality n of second insulator rods being tightly received in said cylindrical insulating tube alternately about the center axis thereof) are tightly received in a cylindrical shielding conductive pipe so that said plurality n of conductive cores are held therein about the center axis thereof, said cylindrical shielding conductive pipe being formed by said cylindrical conductive pipe and having inner and outer diameters smaller than those of the latter.

DETAILED DESCRIPTION OF THE INVENTION

BEST MODE 1 FOR CARRYING OUT THE INVENTION

A description will be given, with reference to FIGS. 1 to 4, of a shielded multi-core cable and its manufacturing method according to a first embodiment of the present invention.

The first embodiment of the shielded multi-core cable manufacturing method according to the present invention, depicted in FIGS. 1 through 4, involves the sequence of steps described below.

Figure 1A:
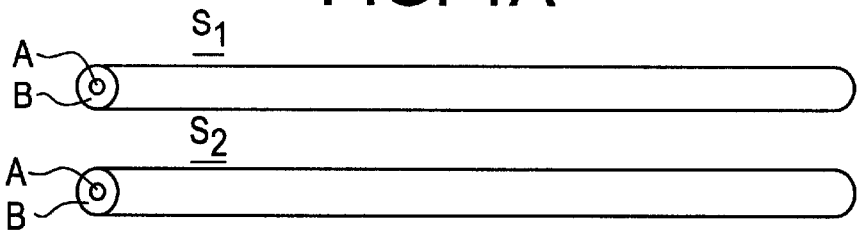
FIG. 1 consists of perspective and sectional views (FIGS. 1A and 1B) schematically illustrating insulator-covered wires and perspective and sectional views (FIGS. 1C and 1D) schematically illustrating a cylindrical conductive pipe, for explaining a first embodiment of the shielded multi-core cable manufacturing method according to the present invention.
Figure 1B:
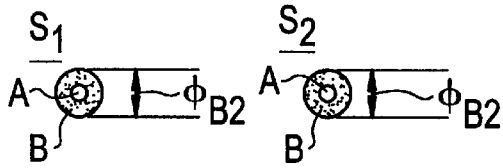
Figure 1C:
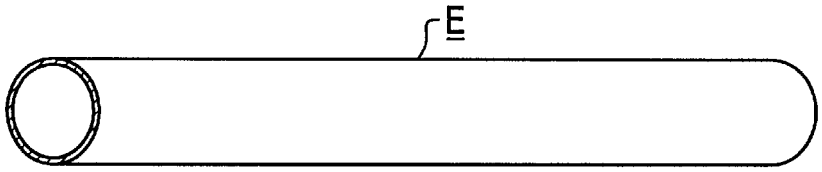
Figure 1D:
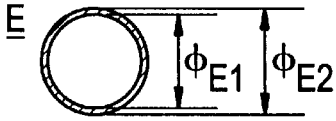

The first step is to prepare plural, for example, two insulator-covered wires S (which are denoted by $S_1$ and $S_2$) each of which has, for example, a circularly-sectioned conductive core A embedded in a cylindrical insulator rod B having an outer diameter $\phi_{B2}$ in a manner to be concentric therewith (FIGS. 1A and B), and a cylindrical conductive pipe E which has an inner diameter $\phi_{E1}$ large enough to receive the two insulator-covered wires $S_1$ and $S_2$ (FIGS. 1C and D). In this case, the inner diameter $\phi_{E1}$ of the conductive pipe E is nearly equal to or larger than the twice ($2\cdot\phi_{B2}$) of the outer diameter $\phi_{B2}$ of each cylindrical insulator rod B having embedded therein one of the insulator-covered wires $S_1$ and $S_2$.

Figure 2A:
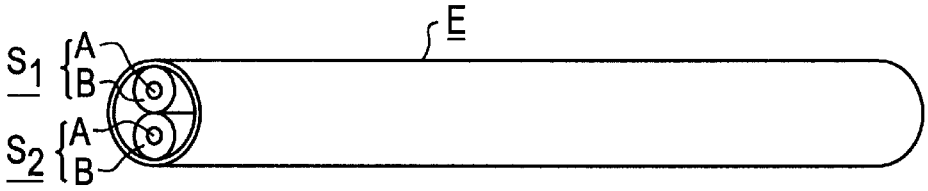
FIG. 2 consists of perspective and sectional views (FIGS. 2A and 2B) schematically illustrating the state in which the insulator-covered wires shown in FIG. 1 are inserted in the cylindrical conductive pipe shown in FIG. 1, for explaining the first embodiment of the shielded multi-core cable manufacturing method according to the present invention.
Figure 2B:
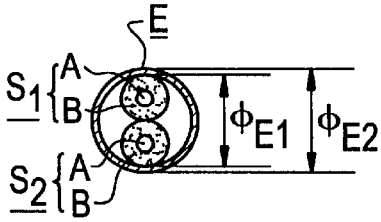

Then, the two insulator-covered wires $S_1$ and $S_2$ are inserted into the conductive pipe E so that they are disposed about the center axis of the pipe E (FIGS. 2A and B). For the sake of brevity, the inner diameter $\phi_{E1}$ of the conductive pipe E is shown to be about twice ($_{2\cdot\phi B2}$) as large as the outer diameter $\phi_{B2}$ of each cylindrical insulator rod B having embedded therein one of the insulator-covered wires $S_1$ and $S_2$.

Figure 3A:
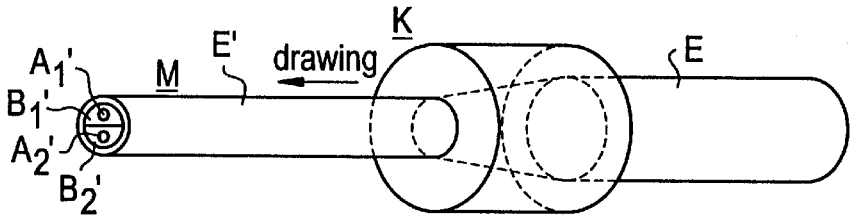
FIG. 3 consists of a perspective view (FIG. 3A) schematically illustrating the drawing of the cylindrical conductive pipe with the insulator-covered wires inserted therein as shown in FIG. 2 and a sectional view (FIG. 3B) also schematically illustrating a drawing die, for explaining the first embodiment of the shielded multi-core cable manufacturing method according to the present invention.
Figure 3B:
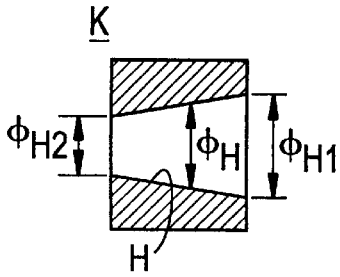

Next, a drawing die K, which is similar to the die K used in the conventional shielded multi-core cable manufacturing method shown in FIGS. 21 through 24, is used to perform drawing of the conductive pipe E having inserted therein the two insulator-covered wires $S_1$ and $S_2$, the drawing die K (FIGS. 3A and B) has a circularly-sectioned through hole H whose inner diameter $\phi_H$ gradually varies lengthwise thereof from one end having an inner diameter $\phi_{H1}$ nearly equal to or larger than the outer diameter $\phi_{E2}$ of the conductive pipe E to the other end having an inner diameter $\phi_{H2}$ smaller than the outer diameter $\phi_{E2}$ of the conductive pipe E. That is, the conductive pipe E is drawn through the through hole H of the drawing die K from the one end of the larger inner diameter $\phi_{H1}$ to the other end of the smaller inner diameter $\phi_{H2}$ (FIG. 3A). By this, a shielded multi-core cable M (FIGS. 4A and B) is obtained in which two insulator rods $B_1'$ and $B_2'$, which are formed by the cylindrical insulator rods B of the two insulator-covered wires S1 and S2 and having embedded therein conductive cores $A_1'$ and $A_2'$ which are respectively formed by the conductive cores A of the two insulator-covered cores $S_1$ and $S_2$, are tightly received in and held integrally with a cylindrical shielding conductive pipe E' about the center axis thereof so that the conductive cores $A_1'$ and $A_2'$ are held therein about the center axis thereof, the cylindrical shielding conductive pipe E' being formed by the cylindrical conductive pipe E and having an outer diameter $\phi_{E2}'$ equal to the smaller inner diameter $\phi_{H2}$ of the through hole H of the drawing die K.

In this instance, if the sum of the areas of the insulator-covered wires $S_1$ and $S_2$ in the plane orthogonal to their axes is substantially equal to or larger than the inner area of the shielding conductive pipe E' of the shielded multi-core cable M in the plane orthogonal to its axis which is defined by the smaller inner diameter $\phi_{H2}$ of the through hole H of the drawing die K, the inside of the shielding conductive pipe E' is completely filled with the insulator rods $B_1'$ and $B_2'$. If however, the abovementioned sum of the areas of the insulator-covered wires $S_1$ and $S_2$ is nearly equal to the inner area of the shielding conductive pipe E', the cylindrical insulator rods B of the ires $S_1$ and $S_2$ will not be pressed out of the shielding conductive pipe E' of the shielded multi-core cable M, so that it is possible to omit the step of removing the excess insulating material after the drawing step as referred to previously in respect of the conventional shielded multi-core cable manufacturing method depicted in FIGS. 21 to 24.

Figure 4A:
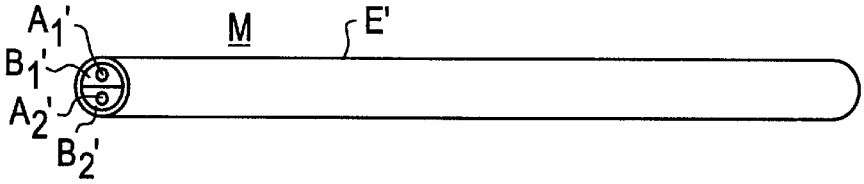
FIG. 4 consists of perspective and sectional views (FIGS. 4A and 4B) schematically illustrating a shielded multi-core cable obtained by the drawing shown in FIG. 3, for explaining the first embodiment of the shielded multi-core cable according to the present invention and its manufacturing method.
Figure 4B:
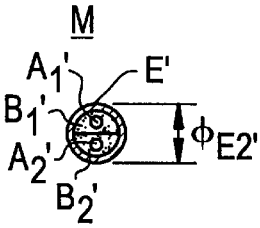
Figure 5:
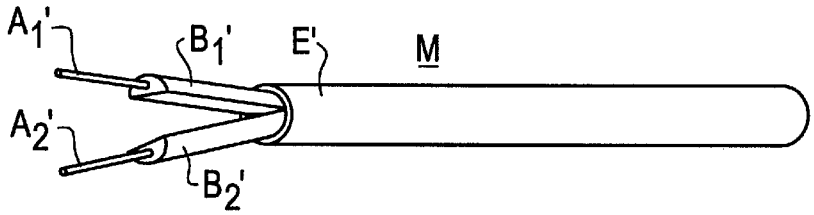
FIG. 5 is a schematic perspective view illustrating the state in which the shielded multi-core cable obtained by the drawing shown in FIG. 3 has been subjected to an end treatment, for explaining the first embodiment of the shielded multi-core cable according to the present invention and its manufacturing method.
Figure 6A:
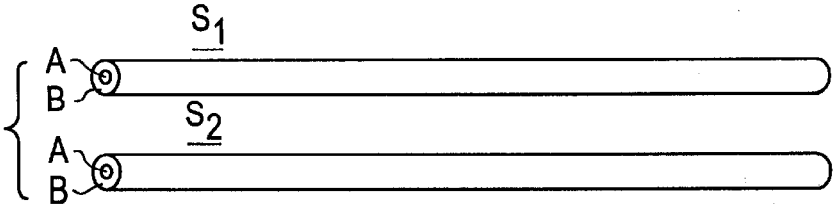
FIG. 6 consists of perspective and sectional views (FIGS. 6A and 6B) schematically illustrating insulator-covered wires, perspective and sectional views (FIGS. 6C and 6D) schematically illustrating cylindrical insulator rods, and perspective and sectional views (FIGS. 6E and 6F) schematically illustrating a cylindrical conductive pipe, for explaining a second embodiment of the shielded multi-core cable manufacturing method according to the present invention.
Figure 6B:
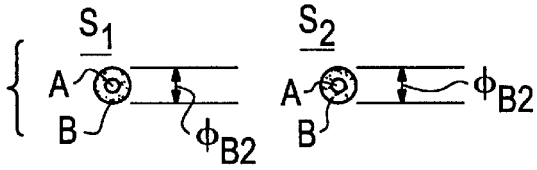
Figure 6C:
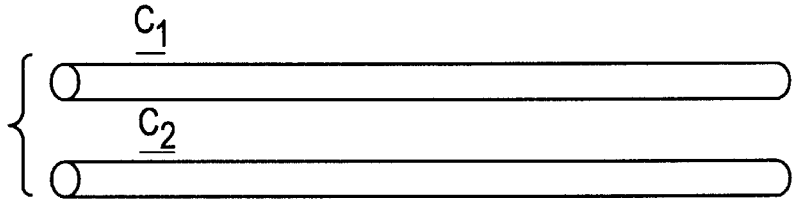
Figure 6D:
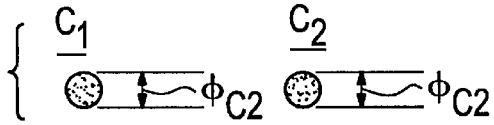
Figure 6E:
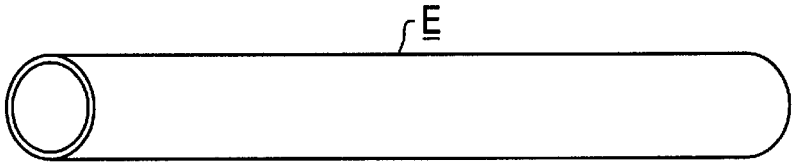
Figure 6F:
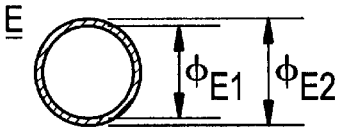

The shielded multi-core cable M (FIG. 4) produced by the first embodiment of the manufacturing method according to the present invention shown in FIGS. 1 to 4 can be used after an end treatment step of peeling off one end portion of the shielding conductive pipe E' to expose end portions of the insulator rods $B_1'$ and $B_2'$ and then partly peeling off their end portions to expose end portions of the conductive cores $A_1'$ and $A_2'$, as is the case with the shielded multi-core cable M fabricated by the conventional method depicted in FIGS. 21 to 24 and as shown in FIG. 5.

In the actual usage of the cable, it is often desired that the free ends of the two conductive cores $A_1'$ and $A_2'$ be widely spaced apart. Since the conductive cores $A_1'$ and $A_2'$ are embedded in the insulator rods $B_1'$ and $B_2'$, respectively, and hence they are separated from each other, the requirement can be met by pulling the free end portions of the insulator rods $B_1'$ and $B_2'$ away from each other and widening the spacing between the insulator rods $B_1'$ and $B_2'$ from the position of the free end of the shielding conducive pipe E' toward the free ends of the insulator rods $B_1'$ and $B_2'$, further followed by widening the spacing between the two conductive cores $A_1'$ and $A_2'$ toward their free ends.

Accordingly, when it is desired to widen the spacing the free ends of the two conductive cores $A_1'$ and $A_2'$ in the actual use of the cable after the end treatment, the requirement can easily be satisfied simply by pulling the free end portions of the insulator rods $B_1'$ and $B_2'$ apart from each other and windening their spacing, without the need for lengthening the exposed free end portions of the two conductive cores $A_1'$ and $A_2'$.

Hence, when the shielded multi-core cable M according to the present invention, shown in FIG. 4, is used after being subjected to the abovementioned end treatment, the free ends of the two conductive cores $A_1'$ and $A_2'$ can be widely spaced apart simply by separating the free end portions of the insulator rods $B_1'$ and $B_2'$ from each other and enlarging their spacing.

With the shielded multi-core cable manufacturing method according to the first embodiment of the present invention depicted in FIGS. 1 through 4, the insulator rods $B_1'$ and $B_2'$ of the cable M are formed by the cylindrical insulator rods B of the insulator-covered wires $S_1$ and $S_2$, and the conductive cores $A_1'$ and $A_2'$ are formed by those A concentrically embedded in the cylindrical insulator rods B of the conductive cores $S_1$ and $S_2$, respectively. Accordingly, the insulator-covered wires $S_1$ and $S_2$ can easily be prepared in which the outer diameter $\phi_{B2}$ of each cylindrical insulator rod B is held accurately over the entire length thereof and each conductive core A is held concentric with the cylindrical insulator rod B accurately over the entire length thereof.

Hence, in the step of drawing the cylindrical conductive pipe E with the two insulator-covered wires $S_1$ and $S_2$ inserted therein, it is possible to obtain the shielded multi-core cable M with ease in which the two insulator rods $B_1'$ and $B_2'$ are arranged exactly in symmetrical relation over the entire length thereof to a plane containing the center axis of the cylindrical shielding conductive pipe E' (in such a manner that the interface between the two insulator rods $B_1'$ and $B_2'$ extends in one plane containing the center axis of the pipe E' with high accuracy) and in which the conductive cores $A_1'$ and $A_2'$ are also arranged exactly in symmetrical relation over the entire length thereof to a plane containing the center axis of the cylindrical shielding conductive pipe E' (in such a manner that the conductive cores $A_1'$ and $A_2'$ are exactly symmetrical to the interface between the two insulator rods $B_1'$ and $B_2'$ extending in one plane containing the center axis of the pipe E' with high accuracy). Accordingly, the shielded multi-core cable M has a construction in which a first plane containing the center axes of the conductive cores $A_1'$ and $A_2'$ passes through the center axis of the shielding conductive pipe E' and the core $A_1$' part and the core $A_2$' part as viewed from a second plane orthogonal to the first one are exactly symmetrical with respect to the second plane.

Thus, the shielded multi-core cable manufacturing method according to the first embodiment of the present invention, shown in FIGS. 1 to 4 allows ease in fabricating the shielded multi-core cable M that has an excellent high-frequency characteristics as compared with the conventional cable of this kind.

Moreover, as is evident from the above, according to the shielded multi-core cable manufacturing method depicted in FIGS. 1 to 4, the insulator rods $B_1$' and $B_2$' having the conductive cores $A_1$' and $A_2$' embedded therein, respectively, are separable from each other; therefore, when the cable M is actually used after the end treatment, the free end portions of the cores $A_1$' and $A_2$' can be widely spaced apart, without increasing their exposed portions, simply by separating the free end portions of the insulator rods $B_1$' and $B_2$' and further opening up their spacing.

BEST MODE 2 FOR CARRYING OUT THE INVENTION

Next, a description will be given, with reference to FIGS. 6 to 9, a shielded multi-core cable and its manufacturing method according to a second embodiment of the present invention.

The parts corresponding to those in FIGS. 1 through 4 are marked with the same reference numerals as in the latter.

The shielded multi-core cable manufacturing method according to the second embodiment of the present invention, depicted in FIGS. 6 to 9, involves the sequence of steps described below.

The first step is to prepare: plural for example, two insulator-covered wires S (which are denoted by $S_1$ and $S_2$) (FIGS. 6A and B) each of which has, for example, a circularly-sectioned conductive core A embedded in a cylindrical insulator rod B having an outer diameter $\phi_{B2}$ in a manner to be concentric therewith (FIGS. 1A and B) as in the first embodiment of the manufacturing method shown in FIGS. 1 to 4; two cylindrical insulator rods C (which are denoted by $C_1$ and $C_2$) (FIGS. 6C and D) each of which has an outer diameter $\phi_{C2}$ equal to or not equal to that $\phi_{B2}$ of the cylindrical insulator rod B; and a cylindrical conductive pipe E (FIGS. 6E and F) which has an inner diameter $\phi_{E1}$ large enough to receive the two insulator-covered wires $S_1$ and $S_2$ and the two cylindrical insulator rods $C_1$ and $C_2$. In this case, the inner diameter $\phi_{E1}$ of the cylindrical conductive pipe E is larger than twice but smaller than three times the outer diameter $\phi_{B2}$ of the cylindrical insulator rods B or the outer diameter $\phi_{C2}$ of the cylindrical insulator rods $C_1$ and $C_2$ when these outer diameters $\phi_{B2}$ and $\phi_{C2}$ are equal. When the outer diameter $\phi_{B2}$ of the cylindrical insulator rods B is larger than the outer diameter $\phi_{C2}$ of the cylindrical insulator rods $C_1$ and $C_2$, the inner diameter $\phi_{E1}$ of the conductive pipe E is larger than twice the outer diameter $\phi_{B2}$ but smaller than the sum of a value twice the outer diameter $\phi_{B2}$ and the outer diameter $\phi_{C2}$. When the outer diameter $\phi_{B2}$ of the cylindrical insulator rods B is smaller than the outer diameter $\phi_{C2}$ of the cylindrical insulator rods $C_1$ and $C_2$, the inner diameter $\phi_{E1}$ of the pipe E is larger than twice the outer diameter $\phi_{C2}$ but smaller than the sum of a value twice the outer diameter $\phi_{C2}$ and the outer diameter $\phi_{B2}$.

Figure 7A:
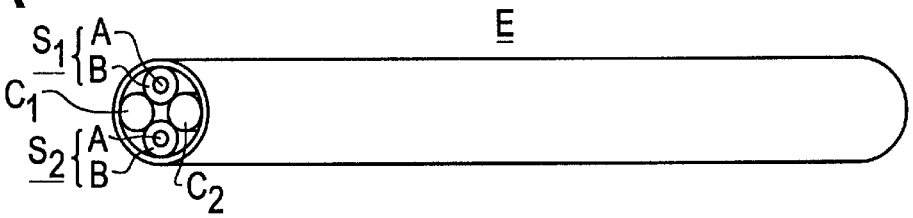
FIG. 7 consists of perspective and sectional views (FIGS. 7A and 7B) schematically illustrating the state in which the insulator-covered wires and cylindrical insulator rods shown in FIG. 6 are inserted in the conductive pipe shown in FIG. 6, for explaining the second embodiment of the shielded multi-core cable manufacturing method according to the present invention.
Figure 7B:
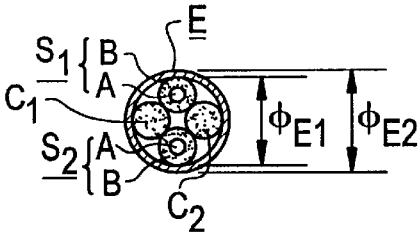

Then, the two insulator-covered wires $S_1$ and $S_2$ and the two cylindrical insulator rods $C_1$ and $C_2$ are inserted into the cylindrical conductive pipe E so that the insulator-covered wires S and the cylindrical insulator rods C are alternately disposed about the center axis of the pipe E (FIGS. 7A and B). For brevity sake, the outer diameters $\phi_{B2}$ of the cylindrical insulator rods B with the insulator-covered wires $S_1$ and $S_2$ embedded therein are shown to be equal to the outer diameters $\phi_{C2}$ of the cylindrical insulator rods $C_1$ and $C_2$, and the inner diameter $\phi_{E1}$ of the conductive pipe E is shown to have such a value that the cylindrical insulator rods B with the insulator-covered wires $S_1$ and $S_2$ embedded therein and the cylindrical insulator rods $C_1$ and $C_2$ are held in contact with the interior surface of the cylindrical conductive pipe E, with the cylindrical insulator rod B of the wire $S_1$ held in contact with those $C_1$ and $C_2$ and the cylindrical insulator rod B of the wire $S_2$ also held in contact therewith.

Figure 8A:
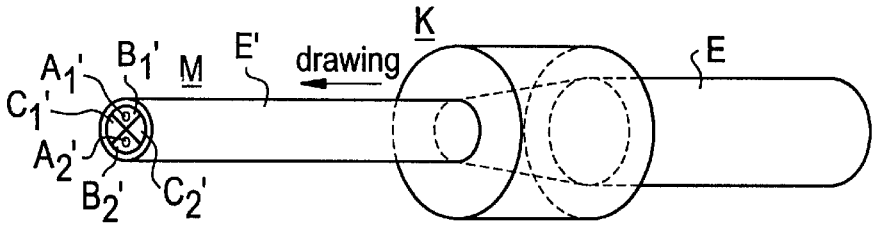
FIG. 8 consists of a perspective view (FIG. 8A) schematically illustrating the drawing of the cylindrical conductive pipe with the insulator-covered wires and the cylindrical insulator rods inserted therein as shown in FIG. 7 and a sectional view (FIG. 8B) also schematically illustrating a drawing die, for explaining the second embodiment of the shielded multi-core cable manufacturing method according to the present invention.
Figure 8B:
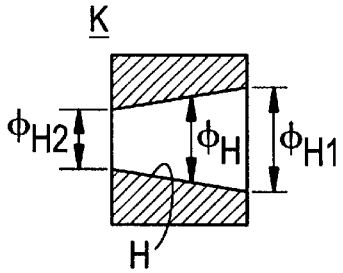

Next, a drawing die K (FIGS. 8A and B), which is similar to the die K used in the first embodiment of the shielded multi-core cable manufacturing method shown in FIGS. 1 through 4, is used to perform drawing of the cylindrical conductive pipe E having inserted therein the two insulator-covered wires $S_1$ and $S_2$ and the two cylindrical insulator rods $C_1$ and $C_2$ as described above. That is, the cylindrical conductive pipe E is drawn through the through hole H of the drawing die K from the one end of the larger inner diameter $\phi_{H1}$ to the other end of the smaller inner diameter $\phi_{H2}$ (FIGS. 8A and B). By this, a shielded multi-core cable M (FIGS. 9A and B) is obtained in which two insulator rods B' (which are denoted by $B_1$' and $B_2$'), which are formed by the cylindrical insulator rods B of the insulator-covered wires $S_1$ and $S_2$ and each of which has embedded therein one of two conductive conductors $A_1$' and $A_2$' formed by the conductive cores A of the two insulator-covered wires $S_1$ and $S_2$, and two insulator rods C' (which are denoted by $C_1$' and $C_2$'), which are formed by the two cylindrical insulator rods $C_1$ and $C_2$, are tightly received in and held integrally with a cylindrical shielding conductive pipe E' alternately about the center axis thereof so that the conductive cores $A_1$' and $A_2$' are held therein about the center axis thereof the cylindrical shielding conductive pipe E' being formed by the cylindrical conductive pipe E and having an outer diameter $\phi_{E2}$' equal to the smaller inner diameter $\phi_{H2}$ of the through hole H of the drawing die K.

In this case, since the inner diameter $\phi_{E1}$ of the cylindrical conductive pipe E, the outer diameter $\phi_{B2}$ of the cylindrical insulator rods B of the insulator-wires $S_1$ and $S_2$ and the outer diameter $\phi_{C2}$ of the cylindrical insulator rods $C_1$ and $C_2$ bear the abovementioned relationships, the cylindrical shielding conductive pipe E' is filled with the insulator rods $B_1$', $B_2$' and $C_1$', $C_2$' alternately disposed about the center axis thereof.

Moreover, if the sum of the area twice those of the insulator-covered wires $S_1$ and $S_2$ in the plane orthogonal to their axes and the area twice those of the cylindrical insulator rods $C_1$ and $C_2$ in the plane orthogonal to their axes is substantially equal to or larger than the inner area of the cylindrical shielding conductive pipe E' of the shielded multi-core cable M in the plane orthogonal to its axis which is defined by the smaller inner diameter $\phi_{H2}$ of the through hole H of the drawing die K, the inside of the cylindrical shielding conductive pipe E' is completely filled with the insulator rods $B_1$', $B_2$' and $C_1$' and $C_2$'. If however, the abovementioned sum of the area twice those of the insulator-covered wires $S_1$ and $S_2$ and the area twice those of the cylindrical insulator rods $C_1$ and $C_2$ is nearly equal to the abovesaid inner area of the cylindrical shielding conductive pipe E', the cylindrical insulator rods B of the wires $S_1$ and $S_2$ and the insulator rods $C_1$ and $C_2$ will not be pressed out of the cylindrical shielding conductive pipe E' of the shielded multi-core cable M, so that it is possible to omit the step of removing the excess insulating materials after the drawing step as referred to previously in respect of the shielded multi-core cable manufacturing method of the present invention depicted in FIGS. 1 to 4.

Figure 9A:
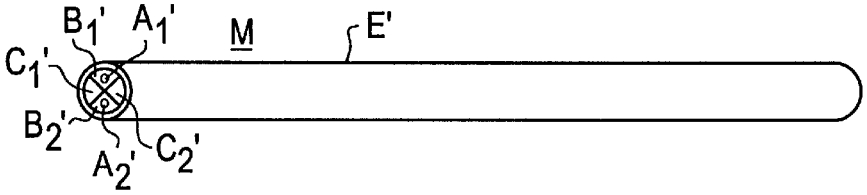
FIG. 9 consists of perspective and sectional views (FIGS. 9A and 9B) schematically illustrating a shielded multi-core cable obtained by the drawing shown in FIG. 8, for explaining the second embodiment of the shielded multi-core cable according to the present invention and its manufacturing method.
Figure 9B:
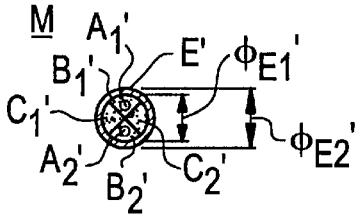
Figure 10:
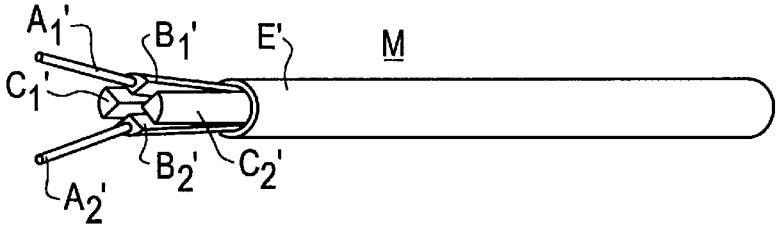
FIG. 10 is a schematic perspective view illustrating the state in which the shielded multi-core cable obtained by the drawing shown in FIG. 8 has been subjected to an end treatment, for explaining the second embodiment of the shielded multi-core cable according to the present invention and its manufacturing method.
Figure 11A:
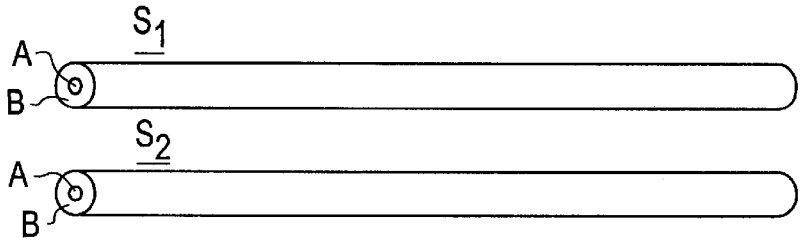
FIG. 11 consists of perspective and sectional views (FIGS. 11A and 11B) schematically illustrating insulator-covered wires, perspective and sectional views (FIGS. 11C and 11D) schematically illustrating a cylindrical insulating tube, and perspective and sectional views (FIGS. 11E and 11F) schematically illustrating a cylindrical conductive pipe, for explaining a third embodiment of the shielded multi-core cable manufacturing method according to the present invention.
Figure 11B:
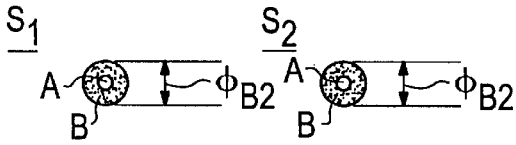
Figure 11C:
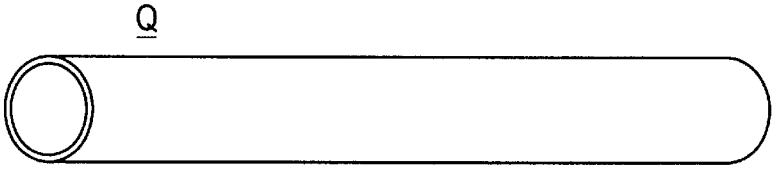
Figure 11D:
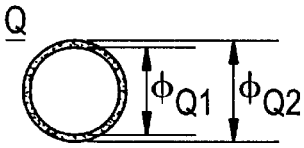
Figure 11E:
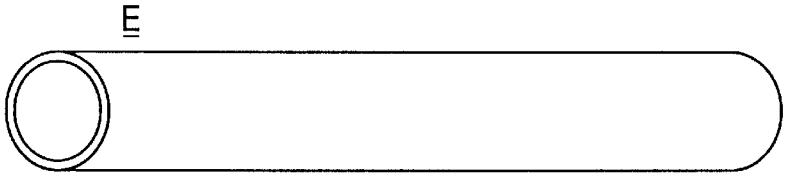
Figure 11F:
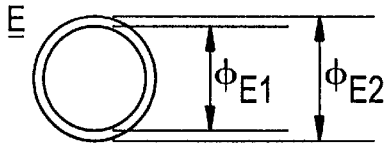

The shielded multi-core cable M (FIG. 9) produced by the second embodiment of the manufacturing method according to the present invention shown in FIGS. 6 to 9 can be used after an end treatment step of peeling off one end portion of the shielding conductive pipe E' to expose end portions of the insulator rods $B_1'$, $B_2'$ and $C_1'$, $C_2'$ and then partly peeling off their end portions to expose end portions of the conductive cores $A_1'$ and $A_2'$ , as is the case with the shielded multi-core cable M fabricated by the manufacturing method according to the first embodiment of the present invention depicted in FIGS. 1 to 4 and as shown in FIG. 10.

In the actual usage of the cable, it is often desired that the free ends of the two conductive cores $A_1'$ and $A_2'$ be widely spaced apart as referred to previously in respect of the cable of the present invention shown in FIG. 4. Since the conductive cores $A_1'$ and $A_2'$ are embedded in the insulator rods $B_1'$ and $B_2'$, respectively, and since the insulator rods $C_1'$ and $C_2'$ as well as $B_1'$ and $B_2'$ arc separable from each other, the requirement can be met by pulling the free end portions of the insulator rods $B_1'$ and $B_2'$ and $C_1'$ and $C_2'$ away from each other and widening the spacing between the insulator rods $B_1'$ and $B_2'$ from the position of the free end of the shielding conducive pipe E' toward the free ends of the insulator rods $B_1'$ and $B_2'$, further followed by opening up the space between the two conductive cores $A_1'$ and $A_2'$ toward their free ends as described previously with reference to FIG. 4.

Accordingly, when it is desired to widen the spacing between the free ends of the two conductive cores $A_1'$ and $A_2'$ in the actual use of the cable after the end treatment, the requirement can easily be satisfied simply by pulling the free end portions of the insulator rods $B_1'$ and $B_2'$ and $C_1'$ and $C_2'$ apart from each other and widening their spacing, without the need for lengthening the exposed free end portions of the two conductive cores $A_1'$ and $A_2'$ as described previously with respect to the shielded multi-core cable of the present invention depicted in FIG. 4.

Hence, when the shielded multi-core cable M according to the present invention, shown in FIG. 9, is used after being subjected to the above mentioned end treatment, the free ends of the two conductive cores $A_1'$ and $A_2'$ can be widely spaced apart simply by separating the free end portions of the insulator rods $B_1'$, $B_2'$ and $C_1'$, $C_2'$ from each other and opening up the space between the free end portions of the insulator rods $B_1'$ and $B_2'$.

With the shielded multi-core cable manufacturing method according to the second embodiment of the present invention depicted in FIGS. 6 through 9, as is the case with the manufacturing method according to the first embodiment of the invention, the insulator rods $B_1'$ and $B_2'$ of the cable M are formed by the cylindrical insulator rods B of the insulator-covered wires $S_1$ and $S_2$, and the conductive cores $A_1'$ and $A_2'$ are formed by those A concentrically embedded in the cylindrical insulator rods B of the conductive cores $S_1$ and $S_2$, respectively; furthermore, the insulator rods $C_1'$ and $C_2'$ are formed by the cylindrical insulator rods $C_1$ and $C_2$, respectively. Accordingly, the insulator-covered wires $S_1$ and $S_2$ can easily be prepared in which the outer diameter $\phi_{B2}$ of each cylindrical insulator rod B is held accurately over the entire length thereof and each conductive core A is held concentric with the cylindrical insulator rod B accurately over the entire length thereof. It is also possible to prepare, with ease, the cylindrical insulator rods $C_1$ and $C_2$ whose outer diameters $\phi_{C1}$ are accurate over the entire length thereof.

Hence, in the step of drawing the cylindrical conductive pipe E with the two insulator-covered wires $S_1$ and $S_2$ and the two cylindrical insulator rods $C_1$ and $C_2$ inserted therein, it is possible to obtain the shielded multi-core cable M with ease in which the two insulator rods $B_1'$ and $B_2'$ are arranged exactly in symmetrical relation over the entire length thereof to a plane containing the center axis of the cylindrical shielding conductive pipe E', the conductive cores $A_1'$ and $A_2'$ are also arranged exactly in symmetrical relation over the entire length thereof to a plane containing the center axis of the cylindrical shielding conductive pipe E', and the insulator rods $C_1'$ and $C_2'$ are also arranged exactly in symmetrical relation over the entire length thereof to a plane containing the center axis of the cylindrical shielding conductive pipe E'. Accordingly, as is the case with the cable M fabricated by the method of the present invention depicted in FIGS. 1 to 4, the shielded multi-core cable M has a construction in which a first plane containing the center axes of the conductive cores $A_1'$ and $A_2'$ passes through the center axis of the cylindrical shielding conductive pipe E' and the core $A_1'$ part and the core $A_2'$ part as viewed from a second plane orthogonal to the first one are exactly symmetrical with respect to the second plane.

Thus, as is the case with the shielded multi-core cable manufacturing method according to the first embodiment depicted in FIGS. 1 to 4, the method according to the second embodiment of the invention, shown in FIGS. 6 to 9, also allows ease in fabricating the shielded multi-core cable M that has an excellent high-frequency characteristic.

Moreover, as is evident from the above, according to the shielded multi-core cable manufacturing method depicted in FIGS. 6 to 9, too, the insulator rods $B_1'$ and $B_2'$ having the conductive cores $A_1'$ and $A_2'$ embedded therein, respectively, and the insulator rods $C_1'$ and $C_2'$ are separable from each other; therefore, when the cable M is actually used after the end treatment, the free end portions of the cores $A_1'$ and $A_2'$ can be widely spaced apart, without increasing their exposed portions, simply by pulling the free end portions of the insulator rods $B_1'$, $B_2'$ and $C_1'$ and $C_2'$ apart from each other and further opening up their spacing.

BEST MODE 3 FOR CARRYING OUT THE INVENTION

A description will be given, with reference to FIGS. 11 to 14, of a shielded multi-core cable and its manufacturing method according to a third embodiment of the present invention.

In FIGS. 11 to 14 the parts corresponding to those in FIGS. 1 through 4 are marked with the same reference numerals as in the latter.

The shielded multi-core cable manufacturing method according to the third embodiment of the present invention, depicted in FIGS. 6 to 9, involves the sequence of steps described below.

The first step is to prepare: plural, for example, two insulator-covered wires S (which are denoted by $S_1$ and $S_2$) (FIGS. 11A and B) each of which has, for example, a circularly-sectioned conductive core A embedded in a cylindrical insulator rod B having an outer diameter $\phi_{B2}$ in a manner to be concentric therewith as in the first embodiment of the manufacturing method shown in FIGS. 1 to 4; a cylindrical insulating tube Q (FIGS. 11C and D) having an inner diameter $\phi_{Q1}$ large enough to receive the two insulator-covered wires $S_1$ and $S_2$; and a cylindrical conductive pipe E (FIGS. 11E and F) which has an inner diameter $\phi_{E1}$ large enough to receive the cylindrical insulating tube Q. In this case, the inner diameter $\phi_{E1}$ of the conductive pipe E is nearly equal to or larger than the outer diameter $\phi_{Q2}$ of the insulating tube Q. The inner diameter $\phi_{Q1}$ of the insulating tube Q is nearly equal to or larger than a value $(2\cdot\phi_{B2})$ twice the outer diameter $\phi_{B2}$ of the cylindrical insulator rods B.

Figure 12A:
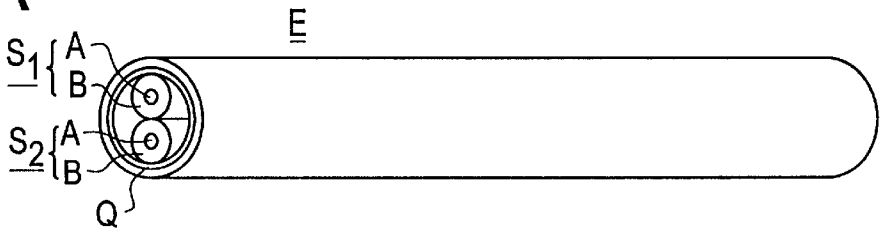
FIG. 12 consists of perspective and sectional views (FIGS. 12A and 12B) schematically illustrating the state in which the cylindrical insulating tube and the insulator-covered wires shown in FIG. 11 are inserted in the cylindrical conductive pipe shown in FIG. 11, for explaining the third embodiment of the shielded multi-core cable manufacturing method according to the present invention.
Figure 12B:
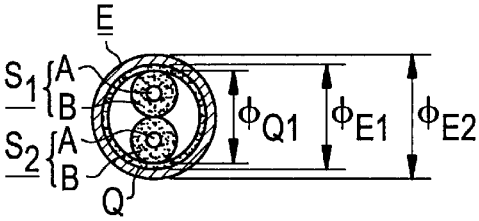

Then, the two insulator-covered wires $S_1$ and $S_2$ and the cylindrical insulating tube Q are inserted into the cylindrical conductive pipe E with the insulator-covered wires $S_1$ and $S_2$ disposed about the center axis of the insulating tube Q (FIGS. 12A and B). For brevity sake, the inner diameter $\phi_{E1}$ of the conductive pipe E is shown to be nearly equal to the outer diameter $\phi_{B2}$ of the insulating tube Q and the inner diameter $\phi_{Q1}$ of the insulating tube Q is substantially twice $(2\cdot\phi_{B2})$ as large as the outer diameter $\phi_{B2}$.

Figure 13A:
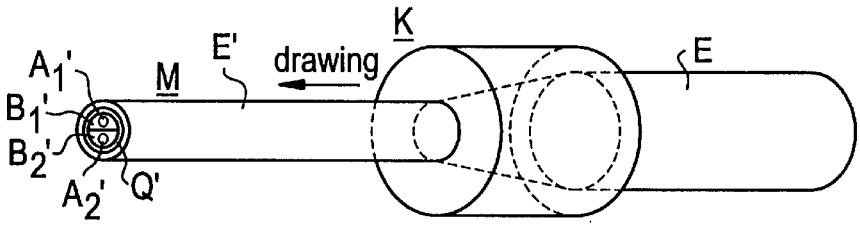
FIG. 13 consists of a perspective view (FIG. 13A) schematically illustrating the drawing of the cylindrical conductive pipe with the cylindrical insulating tube and the insulator-covered wires inserted therein as shown in FIG. 12 and a sectional view (FIG. 13B) also schematically illustrating a drawing die, for explaining the third embodiment of the shielded multi-core cable manufacturing method according to the present invention.
Figure 13B:
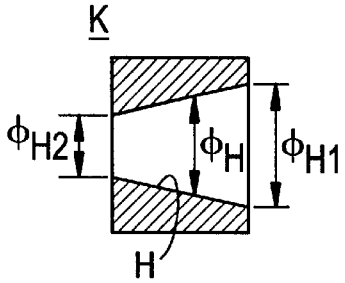

Next, a drawing die K (FIGS. 13A and B), which is similar to that used in the first embodiment of the shielded multi-core cable manufacturing method shown in FIGS. 1 through 4, is used to perform drawing of the cylindrical conductive pipe E having inserted therein the two insulator-covered wires $S_1$ and $S_2$ and the cylindrical insulating tube Q as described above. That is, the cylindrical conductive pipe E is drawn through the through hole H of the drawing die K from the one end of the larger inner diameter $\phi_{H1}$ to the other end of the smaller inner diameter $\phi_{H2}$ (FIGS. 13A and B). By this, a shielded multi-core cable M (FIGS. 14A and B) is obtained in which (1) a cylindrical insulating tube Q', which is formed by the cylindrical insulating tube Q, and (2) two insulator rods $B_1'$ and $B_2'$ which are formed by the cylindrical insulator rods B of the two insulator-covered wires $S_1$ and $S_2$ and each of which has embedded therein one of two conductive cores $A_1'$ and $A_2'$, which are formed by the conductive cores $A_1$ and $A_2$ and which are tightly received in the cylindrical insulating tube Q' side by side about the center axis thereof over the entire length thereof, are tightly received in and held integrally with a cylindrical shielding conductive pipe E' so that the two conductive cores $A_1'$ and $A_2'$ are held therein about the center axis thereof, the cylindrical shielding conductive pipe E' being formed by the cylindrical conductive pipe E and having an outer diameter $\phi_{E2}'$ equal to the smaller inner diameter $\phi_{H2}$ of the through hole H of the drawing die K.

In this case, if the sum of the area twice those of the insulator-covered wires $S_1$ and $S_2$ in the plane orthogonal to their axes and the area of the insulating tube Q in the plane orthogonal to its axis is substantially equal to or larger than the inner area of the cylindrical shielding conductive pipe E' of the shielded multi-core cable M in the plane orthogonal to its axis which is defined by the smaller inner diameter $\phi_{H2}$ of the through hole H of the drawing die K, the inside of the shielding conductive pipe E' is completely filled with the cylindrical insulating tube Q' and the insulator rods $B_1'$ and $B_2'$. If however, the abovementioned sum of the area twice those of the insulator-covered wires $S_1$ and $S_2$ and the area of the insulating tube Q is nearly equal to the abovesaid inner area of the shielding conductive pipe E', the insulating materials forming the cylindrical insulator rods B of the wires $S_1$ and $S_2$ and the insulating tube Q will not be pressed out of the shielding conductive pipe E' of the shielded multi-core cable M, so that it is possible to omit the step of removing the excess insulating materials after the drawing step as referred to previously in respect of the shielded multi-core cable manufacturing method of the present invention depicted in FIGS. 1 to 4.

Figure 14A:
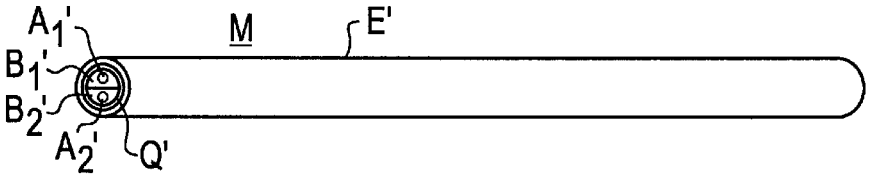
FIG. 14 consists of perspective and sectional views (FIGS. 14A and 14B) schematically illustrating a shielded multi-core cable obtained by the drawing shown in FIG. 13, for explaining the third embodiment of the shielded multi-core cable according to the present invention and its manufacturing method.
Figure 14B:
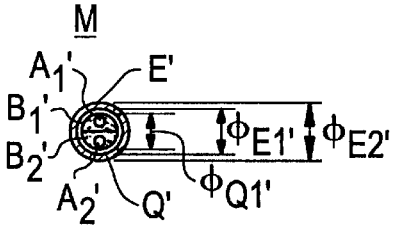
Figure 15:
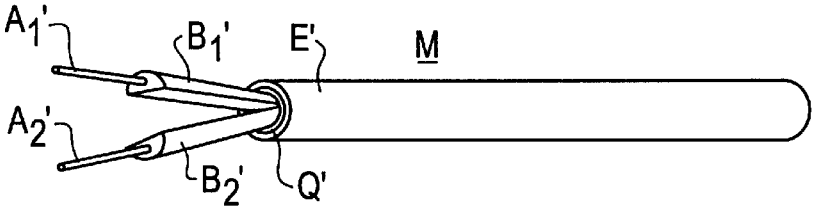
FIG. 15 is a schematic perspective view illustrating the state in which the shielded multi-core cable obtained by the drawing shown in FIG. 13 has been subjected to an end treatment, for explaining the third embodiment of the shielded multi-core cable according to the present invention and its manufacturing method.
Figure 16A:
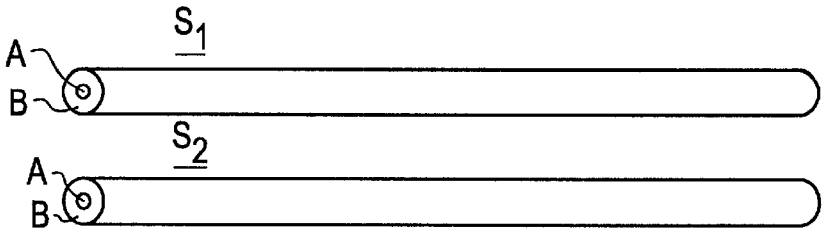
FIG. 16 consists of perspective and sectional views (FIGS. 16A and 16B) schematically illustrating insulator-covered wires, perspective and sectional views (FIGS. 16C and 16D) schematically illustrating cylindrical insulator rods, and perspective, sectional views (FIGS. 16E and 16F) schematically illustrating a cylindrical insulating tube, and perspective and sectional views (FIGS. 16G and 16H) schematically illustrating a cylindrical conductive pipe, for explaining a fourth embodiment of the shielded multi-core cable manufacturing method according to the present invention.
Figure 16B:
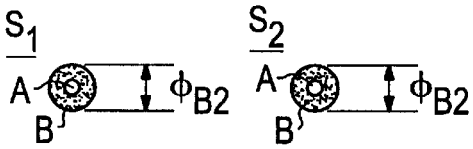
Figure 16C:
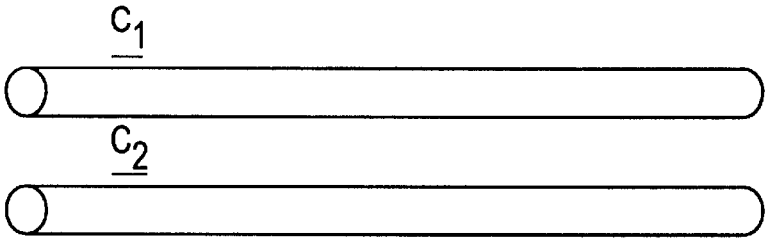
Figure 16D:
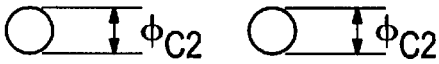
Figure 16E:
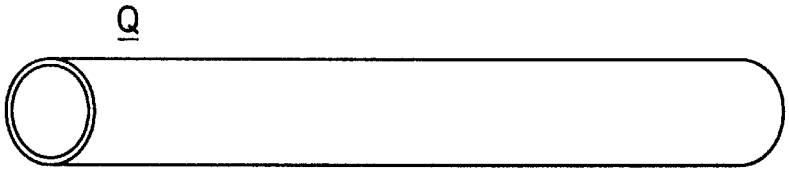
Figure 16F:
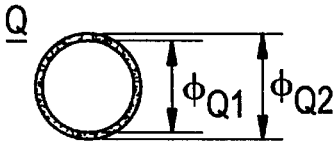
Figure 16G:
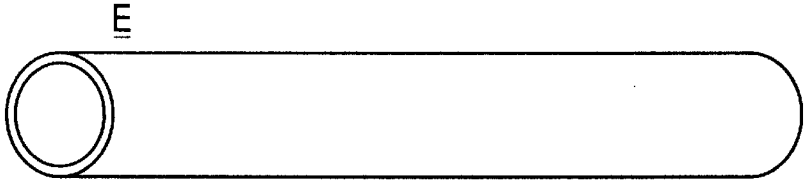
Figure 16H:
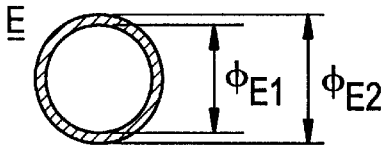

As is the case with the shielded multi-core cable M of the present invention depicted in FIG. 5 and as shown in FIG. 15, the shielded multi-core cable M (FIG. 14) produced by the third embodiment of the manufacturing method according to the present invention shown in FIGS. 11 to 14 can be used after an end treatment step of peeling off one end portion of the shielding conductive pipe E' to expose end portion of the insulating tube Q', then partly peeling off its end portion to expose end portions of the insulator rods $B_1'$ and $B_2'$ and partly peeling off their end portions to expose the end portions of the conductive cores $A_1'$ and $A_2'$.

In the actual usage of the cable M, it is often desired that the free ends of the two conductive cores $A_1'$ and $A_2'$ be widely spaced apart as referred to previously in respect of the cable M of the present invention shown in FIG. 5. Since the conductive cores $A_1'$ and $A_2'$ are embedded in the insulator rods $B_1'$ and $B_2'$, respectively, and since the insulator rods $B_1'$, $B_2'$ are separable from each other, the requirement can be met by pulling the free end portions of the insulator rods $B_1'$ and $B_2'$ away from each other and widening the spacing between the insulator rods $B_1'$ and $B_2'$ from the position of the free end of the shielding conducive pipe E' toward the free ends of the insulator rods $B_1'$ and $B_2'$, further followed by opening up the space between the two conductive cores $A_1'$ and $A_2'$ toward their free ends as described previously with reference to FIG. 5.

Accordingly, when it is desired that the free ends of the two conductive cores $A_1'$ and $A_2'$ be widely spaced apart in the actual use of the cable after the end treatment, the requirement can easily be satisfied simply by pulling the free end portions of the insulator rods $B_1'$, $B_2'$ and $C_1'$, $C_2'$ apart from each other and widening their spacing, without the need for lengthening the exposed free end portions of the two conductive cores $A_1'$ and $A_2'$ as described previously with respect to the shielded multi-core cable M of the present invention depicted in FIG. 4.

Hence, in the case of the shielded multi-core cable M according to the present invention, shown in FIG. 14, too, when it is used after being subjected to the abovementioned end treatment, the free ends of the two conductive cores $A_1'$ and $A_2'$ can be widely spaced apart simply by separating the free end portions of the insulator rods $B_1'$ and $B_2'$ from each other and opening up the space between the free end portions of the insulator rods $B_1'$ and $B_2'$ as is the case with the shielded multi-core cable M of the present invention depicted in FIG. 4.

With the shielded multi-core cable manufacturing method according to the third embodiment of the present invention depicted in FIGS. 11 through 14, the insulator rods $B_1'$ and $B_2'$ of the cable M are formed by the cylindrical insulator rods B of the insulator-covered wires $S_1$ and $S_2$, and the conductive cores $A_1'$ and $A_2'$ are formed by those A concentrically embedded in the cylindrical insulator rods B of the conductive cores $S_1$ and $S_2$, respectively. Accordingly, the insulator-covered wires $S_1$ and $S_2$ can easily be prepared with the outer diameter $\phi_{B2}$ of each cylindrical insulator rod B held accurate over the entire length thereof and each conductive core A held concentric with the cylindrical insulator rod B accurately over the entire length thereof. It is also possible to prepare, with ease, the cylindrical insulating tube Q whose outer and inner diameters $\phi_{Q2}$ and $\phi_{Q1}$ are held accurate over the entire length thereof.

Hence, in the step of drawing the cylindrical conductive pipe E with the two insulator-covered wires $S_1$ and $S_2$ and the cylindrical insulating tube Q inserted therein, it is possible to obtain the shielded multi-core cable M with ease in which the two insulator rods $B_1'$ and $B_2'$ are arranged exactly in symmetrical relation over the entire length thereof to a plane containing the center axis of the cylindrical shielding conductive pipe E', the conductive cores $A_1$' and $A_2$' are also arranged exactly in symmetrical relation over the entire length thereof to a plane containing the center axis of the cylindrical shielding conductive pipe E', and the cylindrical insulating tube Q' is arranged concentrically with the cylindrical shielding conductive pipe E' over the entire length thereof with high accuracy. Accordingly, as is the case with the manufacturing method of the present invention depicted in FIGS. 1 to 4, the shielded multi-core cable M can easily be obtained which has a construction wherein a first plane containing the center axes of the conductive cores $A_1$' and $A_2$' passes through the center axis of the cylindrical shielding conductive pipe E' and the core $A_1$' part and the core $A_2$' part as viewed from a second plane orthogonal to the first one are exactly symmetrical with respect to the second plane.

Thus, as is the case with the shielded multi-core cable manufacturing method according to the first embodiment depicted in FIGS. 1 to 4, the method according to the third embodiment of the invention, shown in FIGS. 11 to 14, also allows ease in fabricating the shielded multi-core cable M that has an excellent high-frequency characteristics.

Moreover, according to the shielded multi-core cable manufacturing method of the third embodiment depicted in FIGS. 11 to 14, too, the conductive cores $A_1$' and $A_2$' are embedded in the insulator rods $B_1$' and $B_2$', respectively, and these insulator rods $B_1$' and $B_2$' are separable from each other; therefore, when the cable M is actually used after the end treatment, the free end portions of the cores $A_1$' and $A_2$' can be widely spaced apart, without increasing their exposed portions, simply by pulling the free end portions of the insulator rods $B_1$' and $B_2$' apart from each other and further opening up their spacing as is the case with the cable fabricated by the method of the first embodiment of the invention.

BEST MODE 4 FOR CARRYING OUT THE INVENTION

A description will be given, with reference to FIGS. 16 to 19, of a shielded multi-core cable and its manufacturing method according to a fourth embodiment of the present invention.

In FIGS. 16 to 19 the parts corresponding to those in FIGS. 6 through 9 and FIGS. 11 through 14 are marked with the same reference numerals as in the latter.

The shielded multi-core cable manufacturing method according to the fourth embodiment of the present invention, depicted in FIGS. 16 to 19, involves the sequence of steps described below.

The first step is to prepare: plural, for example, two insulator-covered wires S (which are denoted by $S_1$ and $S_2$) (FIGS. 16A and B) each of which has, for example, a circularly-sectioned conductive core A embedded in a cylindrical insulator rod B having an outer diameter $\phi_{B2}$ in a manner to be concentric therewith as in the second embodiment of the manufacturing method shown in FIGS. 6 to 9; two cylindrical insulator rods C (which are denoted by $C_1$ and $C_2$) (FIGS. 16C and D) each of which has an outer diameter $\phi_{C2}$ equal to or not equal to that $\phi_{B2}$ of the cylindrical insulator rod B as described previously in respect of the second embodiment of the shielded multi-core cable manufacturing method according to the present invention depicted in FIGS. 6 to 9; a cylindrical insulating tube Q (FIGS. 16E and F) which has an inner diameter $\phi_{Q1}$ large enough to receive the two insulator-covered wires $S_1$ and $S_2$ and the two cylindrical insulator rods $C_1$ and $C_2$ as described previously in respect of the third embodiment of the shielded multi-core cable manufacturing method according to the present invention; and a cylindrical conductive pipe E (FIGS. 16G and H) which has an inner diameter $\phi_{E1}$ large enough to receive the cylindrical insulating tube Q as described previously in respect of the second embodiment of the shielded multi-core cable manufacturing method according to the present invention. In this case, the inner diameter $\phi_{E1}$ of the cylindrical conductive pipe E is nearly equal to or larger than the outer diameter $\phi_{Q2}$ of the cylindrical insulating tube Q. The inner diameter $\phi_{Q1}$ of the insulating tube Q is larger than twice but smaller than three times the outer diameter $\phi_{B2}$ of the cylindrical insulator rod B or the outer diameter $\phi_{C2}$ of the cylindrical insulator rod $C_2$ when these outer diameters $\phi_{B2}$ and $\phi_{C2}$ are equal. When the outer diameter $\phi_{B2}$ of the cylindrical insulator rods B is larger than the outer diameter $\phi_{C2}$ of the cylindrical insulator rods C, the inner diameter $\phi_{Q1}$ of the insulating tube Q is larger than twice the outer diameter $\phi_{B2}$ but smaller than the sum of a value twice the outer diameter $\phi_{B2}$ and the outer diameter $\phi_{C2}$. When the outer diameter $\phi_{B2}$ of the cylindrical insulator rods B is smaller than the outer diameter $\phi_{C2}$ of the cylindrical insulator rods C, the inner diameter $\phi_{Q1}$ of the tube Q is larger than twice the outer diameter $\phi_{C2}$ but smaller than the sum of a value twice the outer diameter $\phi_{C2}$ and the outer diameter $\phi_{B2}$.

Figure 17A:
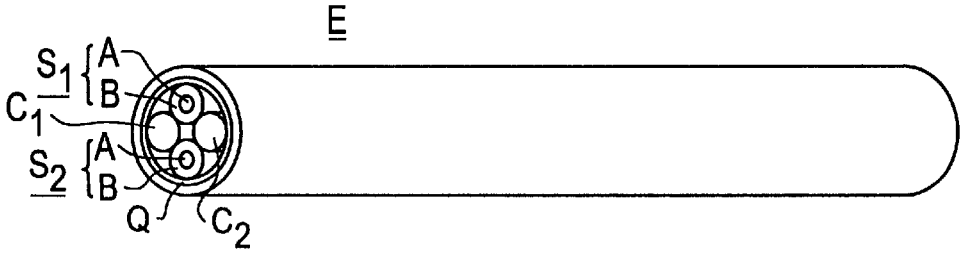
FIG. 17 consists of perspective and sectional views (FIGS. 17A and 17B) schematically illustrating the state in which the cylindrical insulating tube, the insulator-covered wires and the cylindrical insulator rods shown in FIG. 16 are inserted in the cylindrical conductive pipe shown in FIG. 116, for explaining the fourth embodiment of the shielded multi-core cable manufacturing method according to the present invention.
Figure 17B:
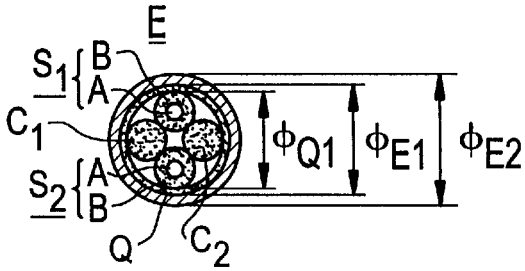

Then, the two insulator-covered wires $S_1$ and $S_2$, the two cylindrical insulator rods $C_1$ and $C_2$ and the cylindrical insulating tube Q are inserted into the cylindrical conductive pipe E so that the two insulator-covered wires $S_1$ and $S_2$ and the two cylindrical insulator rods $C_1$ and $C_2$ are alternately disposed about the center axis of the cylindrical insulating tube Q (FIGS. 17A and B). For brevity sake, the outer diameters $\phi_{B2}$ of the cylindrical insulator rods B with the insulator-covered wires $S_1$ and $S_2$ embedded therein are shown to be equal to the outer diameters $\phi_{C2}$ of the cylindrical insulator rods $C_1$ and $C_2$, and the inner diameter $\phi_{Q1}$ of the cylindrical insulating tube Q is shown to have such a value that the cylindrical insulator rods B with the insulator-covered wires $S_1$ and $S_2$ embedded therein and the cylindrical insulator rods $C_1$ and $C_2$ are held in contact with the interior surface of the cylindrical conductive pipe E, with the cylindrical insulator rod B of the wire $S_1$ held in contact with those $C_1$ and $C_2$ and the cylindrical insulator rod B of the wire $S_2$ also held in contact therewith. Further, the inner diameter $\phi_{E1}$ of the cylindrical conductive pipe E is shown to be nearly equal to the outer diameter $\phi_{Q2}$ of the cylindrical insulating tube Q.

Figure 18A:
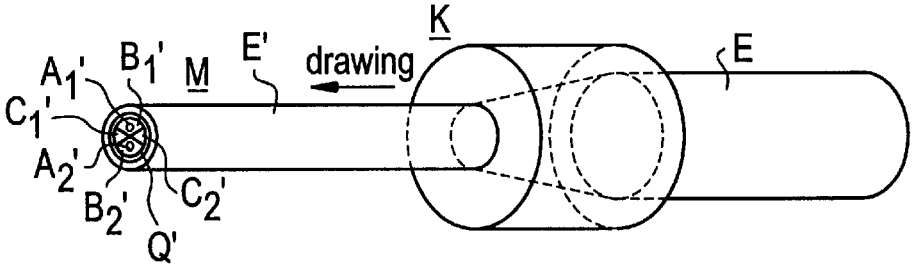
FIG. 18 consists of a perspective view (FIG. 18A) schematically illustrating the drawing of the cylindrical conductive pipe with the insulating tube, the insulator-covered wires and the cylindrical insulator rods inserted therein as shown in FIG. 17 and a sectional view (FIG. 18B) also schematically illustrating a drawing die, for explaining the fourth embodiment of the shielded multi-core cable manufacturing method according to the present invention.
Figure 18B:
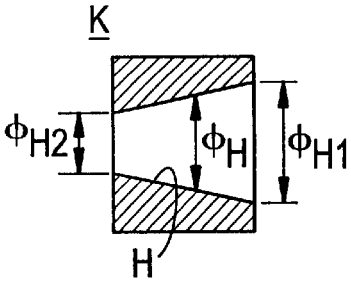

Next, a drawing die K (FIGS. 18A and B), which is similar to the die K used in the second embodiment of the shielded multi-core cable manufacturing method shown in FIGS. 6 through 9, is used to perform drawing of the cylindrical conductive pipe E having inserted therein the two insulator-covered wires $S_1$ and $S_2$, the two cylindrical insulator rods $C_1$ and $C_2$ and the cylindrical insulating tube Q as described above. That is, the cylindrical conductive pipe E is drawn through the through hole H of the drawing die K from the one end of the larger inner diameter $\phi_{H1}$ to the other end of the smaller inner diameter $\phi_{H2}$ (FIGS. 18A and B). By this, a shielded multi-core cable M (FIGS. 19A and B) is obtained in which (1) a cylindrical insulating tube Q', which is formed by the cylindrical insulating tube Q, and (2) two insulator rods B' (which are denoted by $B_1$' and $B_2$'), which are formed by the cylindrical insulator rods B of the two insulator-covered wires $S_1$ and $S_2$ and each of which has embedded therein one of two conductive cores $A_1$' and $A_2$' formed by the conductive cores A of the two insulator-covered wires $S_1$ and $S_2$, and two insulator rods C' (which are denoted by $C_1'$ and $C_2'$), which are formed by the cylindrical insulator rods $C_1$ and $C_2$ (the insulator rods $B_1'$, $B_2'$ and $C_1'$, $C_2'$ being tightly received in the cylindrical insulating tube Q' alternately about the center axis thereof over the entire length thereof) are tightly received in and held integrally with a cylindrical shielding conductive pipe E' so that the conductive cores $A_1'$ and $A_2'$ are held therein about the center axis thereof, the cylindrical shielding conductive pipe E' being formed by the cylindrical conductive pipe E and having an outer diameter $\phi_{E2}'$ equal to the smaller inner diameter $\phi_{H2}$ of the through hole H of the drawing die.

In this case since the inner diameter $\phi_{Q1}$ of the cylindrical insulating tube Q, the outer diameter $\phi_{B2}$ of the cylindrical insulator rods B and the outer diameter $\phi_{C2}$ of the cylindrical insulator rods C bear the abovementioned relationships, the cylindrical insulating tube Q' is filled with the insulator rods $B_1'$, $B_2'$ and $C_1'$, $C_2'$ alternately disposed about the center axis thereof.

Moreover, if the sum of the area twice those of the insulator-covered wires $S_1$ and $S_2$ in the plane orthogonal to their axes, the area twice those of the cylindrical insulator rods $C_1$ and $C_2$ in the plane orthogonal to their axes and the sectional area of the cylindrical insulating tube Q in the plane orthogonal to the axis thereof is substantially equal to or larger than the inner sectional area of the cylindrical shielding conductive pipe E' of the shielded multi-core cable M in the plane orthogonal to its axis which is defined by the smaller inner diameter $\phi_{H2}$ of the through hole H of the drawing die K, the cylindrical shielding conductive pipe E' is completely filled with the insulator rods $B_1'$, $B_2'$ and $C_1'$ and $C_2'$ and the cylindrical insulating tube Q'. If however, the abovementioned sum of the area twice those of the insulator-covered wires $S_1$ and $S_2$, the area twice those of the insulator rods $C_1$ and $C_2$ and abovesaid sectional area of the insulating tube Q is nearly equal to the abovesaid inner sectional area of the shielding conductive pipe E', the insulating materials forming the cylindrical insulator rods B covering the wires $S_1$ and $S_2$, the insulator rods $C_1$ and $C_2$ and the insulating tube Q will not be pressed out of the shielding conductive pipe E' of the shielded multi-core cable M, so that it is possible to omit the step of removing the excess insulating materials after the drawing step as referred to previously in respect of the shielded multi-core cable manufacturing method of the present invention depicted in FIGS. 6 to 9.

Figure 19A:
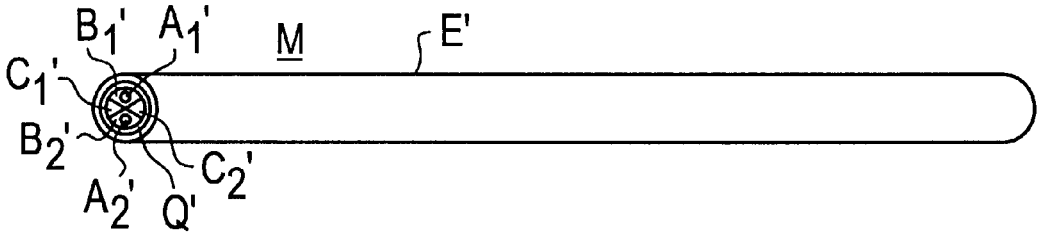
FIG. 19 consists of perspective and sectional views (FIGS. 19A and 19B) schematically illustrating a shielded multi-core cable obtained by the drawing shown in FIG. 18, for explaining the fourth embodiment of the shielded multi-core cable according to the present invention and its manufacturing method.
Figure 19B:
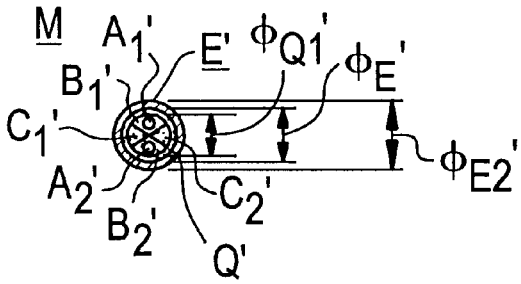
Figure 20:
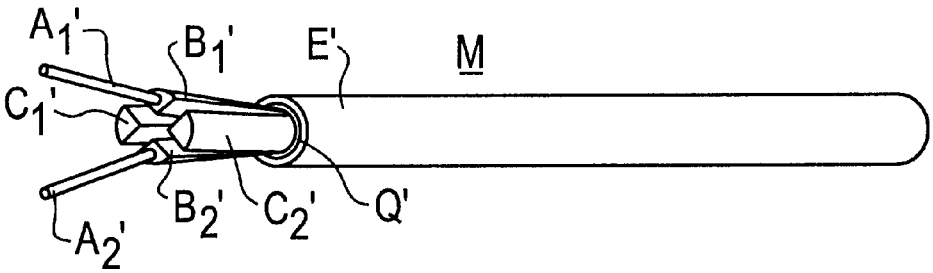
FIG. 20 is a schematic perspective view illustrating the state in which the shielded multi-core cable obtained by the drawing shown in FIG. 18 has been subjected to an end treatment, for explaining the fourth embodiment of the shielded multi-core cable according to the present invention and its manufacturing method.
Figure 21A:
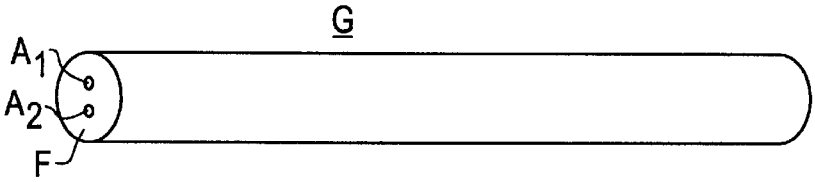
FIG. 21A PRIOR ART
FIG. 21 consists of perspective and sectional views (FIGS. 21A and 21B) schematically showing an insulator-covered wire and perspective and sectional views (FIGS. 21C and 21D) schematically showing a cylindrical conductive pipe, for explaining a conventional shielded multi-core cable manufacturing method.
Figure 21B:
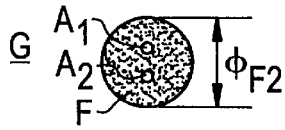
FIG. 21B PRIOR ART
Figure 21C:
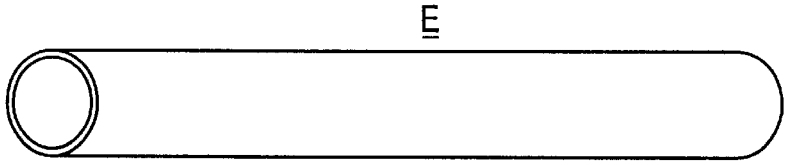
FIG. 21C PRIOR ART
Figure 21D:
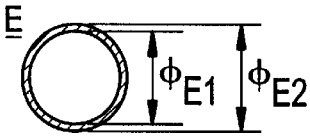
FIG. 21D PRIOR ART
Figure 22A:
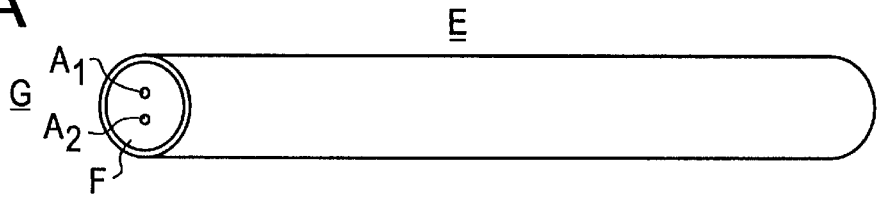
FIG. 22A PRIOR ART
FIG. 22 consists of perspective and sectional views (FIGS. 22A and 22B) schematically illustrating the state in which the insulator-covered wire shown in FIG. 21 is inserted in the cylindrical conductive pipe shown in FIG. 21, for explaining the conventional shielded multi-core cable manufacturing method.
Figure 22B:
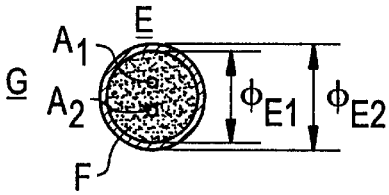
FIG. 22B PRIOR ART
Figure 23A:
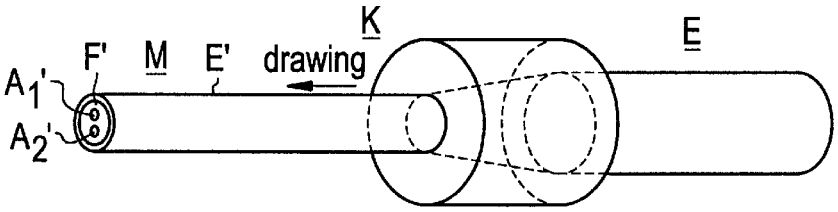
FIG. 23A PRIOR ART
FIG. 23 consists of a perspective view (FIG. 23A) schematically illustrating the drawing of the cylindrical conductive pipe with the insulator-covered wire inserted therein as shown in FIG. 22 and a sectional view (FIG. 23B) also schematically illustrating a drawing die, for explaining the conventional shielded multi-core cable manufacturing method.
Figure 23B:
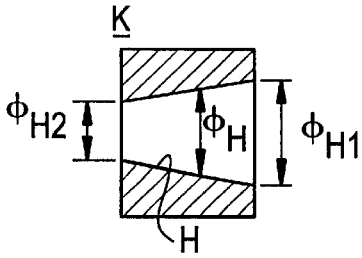
FIG. 23B PRIOR ART
Figure 24A:
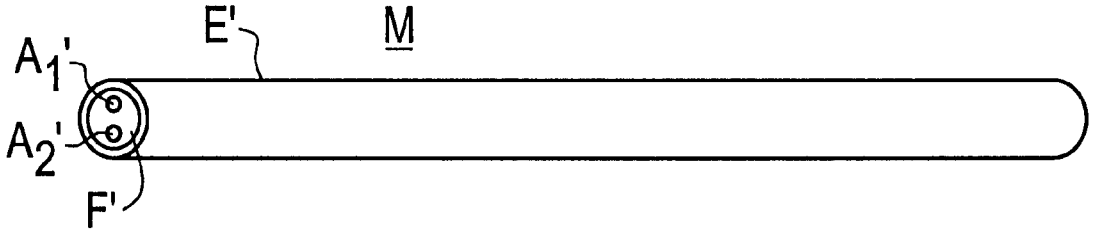
FIG. 24A PRIOR ART
FIG. 24 consists of perspective and sectional views (FIGS. 24A and 24B) schematically illustrating a shielded multi-core cable obtained by the drawing shown in FIG. 23, for explaining the conventional shielded multi-core cable and its manufacturing method.
Figure 24B:
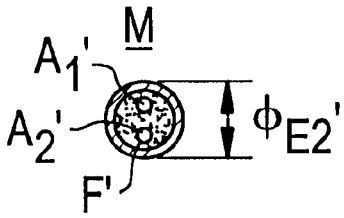
FIG. 24B PRIOR ART
Figure 25:
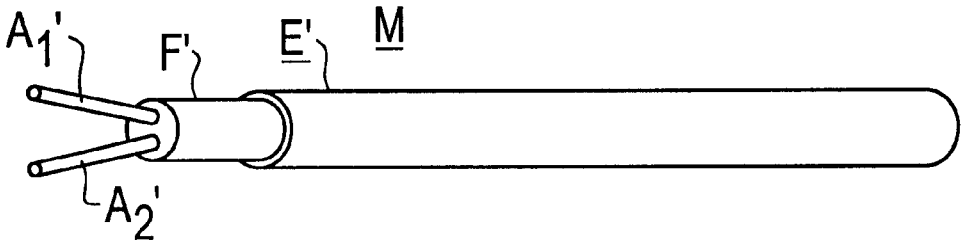
FIG. 25 is a schematic perspective view illustrating the state in which the shielded multi-core cable obtained by the drawing shown in FIG. 23 has been subjected to an end treatment, for explaining the conventional shielded multi-core cable and its manufacturing method.

The shielded multi-core cable M (FIG. 19) produced by the fourth embodiment of the manufacturing method according to the present invention shown in FIGS. 16 to 19 can be used after an end treatment step of peeling off one end portion of the shielding conductive pipe E' to expose one end portion of the insulating tube Q', the peeling off the exposed end portion of the insulating tube Q' to expose free end portions of the insulator rods $B_1'$, $B_2'$ and $C_1'$, $C_2'$ and then partly peeling off their exposed end portions to expose end portions of the conductive cores $A_1'$ and $A_2'$, as is the case with the shielded multi-core cable M according to the present invention depicted in FIG. 15 and as shown in FIG. 20.

In the actual usage of the cable, it is often desired that the free ends of the two conductive cores $A_1'$ and $A_2'$ be widely spaced apart as referred to previously in respect of the cable M of the present invention shown in FIG. 14. Since the conductive cores $A_1'$ and $A_2'$ are embedded in the insulator rods $B_1'$ and $B_2'$, respectively, and since the insulator rods $C_1'$, $C_2'$ as well as $B_1'$, $B_2'$ are separable from each other, the requirement can be met by pulling the free end portions of the insulator rods $B_1'$, $B_2'$ and $C_1'$, $C_2'$ away from each other and widening the spacing between the insulator rods $B_1'$ and $B_2'$ from the position of the free end of the insulating tube Q' toward the free ends of the insulator rods $B_1'$ and $B_2'$, further opening up the space between the two conductive cores $A_1'$ and $A_2'$ toward their free ends as described previously lo with reference to FIG. 15.

Accordingly, when it is desired to widen the spacing between the free ends of the two conductive cores $A_1'$ and $A_2'$ in the actual use of the cable M after the end treatment, the requirement can easily be satisfied simply by pulling the free end portions of the insulator rods $B_1'$ ,$B_2'$ and $C_1'$, $C_2'$ apart from is each other and widening their spacing, without the need for lengthening the exposed free end portions of the two conductive cores $A_1'$ and $A_2'$ as described previously with respect to the shielded multi-core cable M of the present invention depicted in FIG. 14.

Hence, when the shielded multi-core cable M according to the present invention, shown in FIG. 19, is used after being subjected to the abovementioned end treatment, the free ends of the two conductive cores $A_1'$ and $A_2'$ can be widely spaced apart simply by separating the free end portions of the insulator rods $B_1'$, $B_2'$ and $C_1'$, $C_2'$ from each other and opening up the space between the free end portions of the insulators $B_1'$ and $B_2'$ as is the case with the shielded multi-core cable M of the present invention shown in FIG. 14.

With the shielded multi-core cable manufacturing method according to the fourth embodiment of the present invention depicted in FIGS. 16 through 19, the insulator rods $B_1'$ and $B_2'$ of the cable M are formed by the cylindrical insulator rods B of the insulator-covered wires $S_1$ and $S_2$, and the conductive cores $A_1'$ and $A_2'$ are formed by those A concentrically embedded in the cylindrical insulator rods B of the conductive cores $S_1$ and $S_2$, respectively; furthermore, the insulator rods $C_1'$ and $C_2'$ are formed by the cylindrical insulator rods $C_1$ and $C_2$, respectively. Accordingly, the insulator-covered wires $S_1$ and $S_2$ can easily be prepared with the outer diameter $\phi_{B2}$ of each cylindrical insulator rod B held accurately over the entire length thereof and with each conductive core A held concentric with the cylindrical insulator rod B accurately over the entire length thereof. It is also possible to prepare, with ease, the cylindrical insulator rods $C_1$ and $C_2$ whose outer diameters $\phi_{C2}$ are accurate over the entire length thereof The cylindrical insulating tube Q can easily be prepared with its outer and inner diameters $\phi_{Q2}$ and $\phi_{Q1}$ held accurate over the entire length thereof.

Hence, by the step of drawing the cylindrical conductive pipe E with the two insulator-covered wires $S_1$ and $S_2$, the two cylindrical insulator rods $C_1$ and $C_2$ and the cylindrical insulating tube Q inserted therein, it is possible to obtain the shielded multi-core cable M with ease in which: the two insulator rods $B_1'$ and $B_2'$ are arranged exactly in symmetrical relation over the entire length thereof to a plane containing the center axis of the cylindrical shielding conductive pipe E'; the conductive cores $A_1'$ and $A_2'$ are also arranged exactly in symmetrical relation over the entire length thereof to a plane containing the center axis of the cylindrical shielding conductive pipe E'; the insulator rods $C_1'$ and $C_2'$ are also arranged exactly in symmetrical relation over the entire length thereof to a plane containing the center axis of the cylindrical shielding conductive pipe E'; and the cylindrical insulating tube Q' is held concentrically with the cylindrical shielding conductive pipe E' accurately over the entire length thereof. Accordingly, as is the case with the shielded multi-core cable manufacturing method of the present invention depicted in FIGS. 6 to 9, the shielded multi-core cable M has a construction in which a first plane containing the center axes of the conductive cores $A_1'$ and $A_2'$ passes through the center axis of the cylindrical shielding conductive pipe E' and the core $A_1'$ part and the core $A_2'$ part as viewed from a second plane orthogonal to the first one are exactly symmetrical with respect to the second plane.

Thus, as is the case with manufacturing method according to the second embodiment of the present invention depicted in FIGS. 6 to 9, the shielded multi-core cable manufacturing method according to the fourth embodiment depicted in FIGS. 16 to 19, also allows ease in fabricating the shielded multi-core cable M that has an excellent high-frequency characteristics.

Moreover, according to the shielded multi-core cable manufacturing method depicted in FIGS. 16 to 19, too, the insulator rods $B_1'$ and $B_2'$ having the conductive cores $A_1'$ and $A_2'$ embedded therein, respectively, and the insulator rods $C_1'$ and $C_2'$ are separable from each other as is case with the cable manufacturing method of the present invention depicted in FIGS. 6 to 9; therefore, when the cable M is actually used after the end treatment, the free end portions of the cores $A_1'$ and $A_2'$ can be widely spaced apart, without increasing their exposed portions, simply by pulling the free end portions of the insulator rods $B_1'$, $B_2'$ and $C_1'$ and $C_2'$ apart from each other and further opening up the space between the free ends of the insulator rods $B_1'$ and $B_2'$.

While in the above the present invention has been described as being applied to a shielded multi-core cable having two conductive cores and its manufacturing method, it will be apparent to those skilled in the art that the same results as described above could be obtained by applying the invention to a shielded multi-core cable having a plurality n of cores more than two and its manufacture in a manner similar to that described above.

What is claimed is:

1. A shielded multi-core cable manufacturing method, comprising the steps of:

preparing (a) two insulator-covered wires $S_1$ and $S_2$ each having a conductive core A embedded in a first cylindrical insulator rod B having an outer diameter $\phi_{B2}$ in a manner to be concentric therewith, (b) two second cylindrical insulator rods $C_1$ and $C_2$ each having an outer diameter $\phi_{C2}$ equal to or not equal to the outer diameter $\phi_{B2}$ of the first cylindrical insulator B, and (c) a cylindrical conductive pipe E having an inner diameter $\phi_{E1}$ larger than twice the outer diameter $\phi_{B2}$ of the first cylindrical insulator rod B but smaller than a sum of twice the outer diameter $\phi_{B2}$ of the first cylindrical insulator rod B and the outer diameter $\phi_{C2}$ of the second cylindrical insulator rods $C_1$ and $C_2$, the inner diameter $\phi_{E1}$ of said cylindrical conductive pipe E being defined through utilization of the outer diameter $\phi_{B2}$ of the first cylindrical insulator rod B of said two insulator-covered wires $S_1$ and $S_2$ and the outer diameter $\phi_{C2}$ of the second cylindrical insulator rods $C_1$ and $C_2$;

inserting said two insulator-covered wires $S_1$ and $S_2$ and said two second cylindrical insulator rods $C_1$ and $C_2$ into said cylindrical conductive pipe E alternately arranged about the center axis thereof; and drawing said cylindrical conductive pipe E with said two insulator-covered wires $S_1$ and $S_2$ and said two second cylindrical insulator rods $C_1$ and $C_2$ inserted therein, thereby obtaining a shielded multi-core cable of a construction in which (a) two first insulator rods $B_1'$ and $B_2'$, formed respectively from the first cylindrical insulator rods B of said insulator-covered wires $S_1$ and $S_2$ and having respectively embedded therein two conductive core $A_1'$ and $A_2'$ which are respectively of the conductive core A of the insulator-covered wire $S_1$ and $S_2$, and (b) two second insulator rods $C_1'$ and $C_2'$, formed respectively from said two second cylindrical insulator rods $C_1$ and $C_2$, are tightly received in a cylindrical shielding conductive pipe E' being formed from said cylindrical conductive pipe E so that said two conductive cores $A_1'$ and $A_2'$ are held therein about the center axis thereof, said cylindrical shielding conductive pipe E' having inner and outer diameters smaller than those of said cylindrical conductive pipe E;

wherein (i) the line joining the centers of the conductive cores $A_1'$ and $A_2'$ passes through the center of the cylindrical shielding conductive pipe E', and hence the conductive cores $A_1'$ and $A_2'$ are symmetrical in terms of position and configuration with respect to a line that crosses at right angles the line joining the centers of the conductive cores $A_1'$ and $A_2'$ and passes through the center of the cylindrical shielding conductive pipe E', (ii) the first insulator rods $B_1'$ and $B_2'$ are disposed with their inner sharp edges held along the center of the cylindrical shielding conductive pipe E', and they are exactly or substantially symmetrical in terms of position and configuration with respect to the line that crosses at right angles the line joining the centers of the conductive cores $A_1'$ and $A_2'$ and passes through the center of the cylindrical conductive pipe E', (iii) the second insulator rods $C_1'$ and $C_2'$ are disposed with their inner sharp edges held along the center of the cylindrical shielding conductive pipe E', and they are exactly or substantially symmetrical in terms of position and configuration with respect to the line joining the centers of the conductive cores $A_1'$ and $A_2'$, and the space between the conductive cores $A_1'$ and $A_2'$ is controlled by the outer diameter $\phi_{C2}$ of each of the second cylindrical insulator rods $C_1$ and $C_2$.

2. A shielded multi-core cable manufacturing method, comprising the steps of:

preparing (a) two insulator-covered wires $S_1$ and $S_2$ each having a conductive core A embedded in a first cylindrical insulator rod B having an outer diameter $\phi_{B2}$ in a manner to be concentric therewith, (b) two second cylindrical insulator rods $C_1$ and $C_2$ each having an outer diameter $\phi_{C2}$ equal to or not equal to the outer diameter $\phi_{B2}$ of the first cylindrical insulator rod B, (c) a first cylindrical insulating tube Q having an inner diameter $\phi_{Q1}$ larger than twice the outer diameter $\phi_{B2}$ of the first cylindrical insulator rod B but smaller than a sum of twice the outer diameter $\phi_{B2}$ of the first cylindrical insulator rod B and the outer diameter $\phi_{C2}$ of the second cylindrical insulator rods $C_1$ and $C_2$, and (d) a cylindrical conductive pipe E having an inner diameter nearly equal to the outer diameter of the first cylindrical insulating tube Q, the inner diameter $\phi_{E1}$ of said cylindrical conductive pipe E being defined through utilization of the outer diameter $\phi_{Q2}$ and the inner diameter $\phi_{Q1}$ of the first cylindrical insulating tube Q, the outer diameter $\phi_{B2}$ of the first cylindrical insulator rod B of said two insulator-covered wires $S_1$ and $S_2$ and the outer diameter $\phi_{C2}$ of said two cylindrical insulator rods $C_1$ and $C_2$;

inserting said two insulator-covered wires $S_1$ and $S_2$, said two second cylindrical insulator rods $C_1$ and $C_2$ and said first cylindrical insulating tube Q into said cylindrical conductive pipe E so that said first cylindrical insulating tube Q receives said two insulator-covered wires $S_1$ and $S_2$ and said two second cylindrical insulator rods $C_1$ and $C_2$ alternately arranged about the center axis thereof; and drawing said cylindrical conductive pipe E with said two insulator-covered wires $S_1$ and $S_2$, said two second cylindrical insulator rods $C_1$ and $C_2$ and said first cylindrical insulating tube Q inserted therein, thereby obtaining a shielded multi-core cable of a construction in which (a) a second cylindrical insulating tube Q' formed from said first cylindrical insulating tube Q, (b) two first insulator rods $B_1$' and $B_2$' formed respectively from the first cylindrical insulator rods A of the insulator-covered wires $S_1$ and $S_2$ and having respectively embedded therein two conductive cores $A_1$' and $A_2$' being respectively the conductive cores A of the insulator-covered wire $S_1$ and $S_2$, and (c) two second insulator rods $C_1$' and $C_2$' formed from said two second cylindrical insulator rods $C_1$ and $C_2$ are tightly received in a cylindrical shielding conductive pipe E' being formed from said cylindrical conductive pipe E so that (a) said two first insulator rods $B_1$' and $B_2$' and said two second insulator rods $C_1$' and $C_2$' are tightly received in said second cylindrical insulating tube Q' alternately arranged about the center axis thereof and (b) said two conductive cores $A_1$' and $A_2$' are held in the cylindrical shielding conductive pipe E' about the center axis thereof, said second cylindrical insulating tube Q' having inner and outer diameters smaller than those of said first cylindrical insulating tube Q, said cylindrical shielding conductive pipe E' having inner diameter equal to that of the second cylindrical insulating tube Q' and smaller than that of the cylindrical conductive pipe E and outer diameters smaller than that of the cylindrical conductive pipe E;

wherein (i) the second cylindrical insulating tube Q' is concentric with the cylindrical shielding conductive pipe E', (ii) the line joining the centers of the conductive cores $A_1$' and $A_2$' passes through the center of the cylindrical shielding conductive pipe E', and hence the conductive cores $A_1$' and $A_2$' are symmetrical in terms of position and configuration with respect to a line that crosses at right angles the line joining the centers of the conductive cores $A_1$' and $A_2$' and passes through the center of the cylindrical shielding conductive pipe E', (iii) the first insulator rods $B_1$' and $B_2$' are disposed with their inner sharp edges held along the center of the cylindrical shielding conductive pipe E', and they are exactly or substantially symmetrical in terms of position and configuration with respect to the line that crosses at right angles the line joining the centers of the conductive cores $A_1$' and $A_2$' and passes through the center of the cylindrical shielding conductive pipe E', (iv) the second insulator rods $C_1$' and $C_2$' are disposed with their inner sharp edges held along the center of the cylindrical shielding conductive pipe E', and they are exactly or substantially symmetrical in terms of position and configuration with respect to the line joining the centers of the conductive cores $A_1$' and $A_2$', (v) the space between the conductive cores $A_1$' and $A_2$' is controlled by the outer diameter $\phi_{C2}$ of each of the second cylindrical insulator rods $C_1$ and $C_2$, (vi) the spaces between he conductive cores $A_1$' and $A_2$' and the cylindrical shielding conductive pipe E' are controlled by the difference between the outer and inner diameters $\phi_{C1}$ and $\phi_{C2}$ of the first cylindrical insulating tube Q.

* * * * *